US006232993B1

(12) United States Patent
Kobayashi et al.

(10) Patent No.: US 6,232,993 B1
(45) Date of Patent: May 15, 2001

(54) TAPE PRINTERS AND PRINTING MEDIUM CONTAINING CASSETTES

(75) Inventors: Kenji Kobayashi, Akiruno; Kenji Igarashi, Tokyo; Masayuki Ikeda, Kawaguchi; Kensaku Takeuchi, Kokubunji; Kenzo Ito, Kodaira, all of (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/152,821

(22) Filed: Sep. 14, 1998

(30) Foreign Application Priority Data

Sep. 18, 1997 (JP) ..... 9-252975

(51) Int. Cl.[7] ..... B41J 1/14
(52) U.S. Cl. ..... 347/175
(58) Field of Search ..... 347/173, 174, 347/172, 175, 218; 400/231, 120.02, 120.03

(56) References Cited

U.S. PATENT DOCUMENTS

| | | | | |
|---|---|---|---|---|
| 4,734,704 | | 3/1988 | Mizutani et al. | 347/173 |
| 5,435,658 | | 7/1995 | Hasegawa . | |
| 5,536,092 | * | 7/1996 | Yamaguchi | 400/231 |
| 5,629,729 | | 5/1997 | Fujishiro | 347/175 |
| 5,711,620 | * | 1/1998 | Sasaki et al. | 347/173 |
| 5,725,318 | * | 3/1998 | Yamaguchi et al. | 347/174 |
| 5,747,995 | | 5/1998 | Spies | 324/207 |

FOREIGN PATENT DOCUMENTS

| | | | |
|---|---|---|---|
| 0 111 287 A2 | 6/1984 | (EP) | B41J/3/20 |
| 0 629 509 A2 | 12/1994 | (EP) | B41J/3/407 |
| 0 766 066 A1 | 4/1997 | (EP) | G01D/5/14 |
| 4-10879 | 2/1992 | (JP) . | |
| 6-51425 | 7/1994 | (JP) . | |

OTHER PUBLICATIONS

Patent Abstracts of Japan, vol. 017, No. 483 (M–1472), Sep. 2, 1993 (Sep. 2, 1993) and JP 05–116470 A (Fuji Photo Film Co., Ltd.), May 14, 1993—Abstract.
Patent Abstracts of Japan, vol. 096, No. 007, Jul. 31, 1996 (Jul. 31, 1996) and JP 08–058122 A (Fuji Photo Film Co., Ltd.), Mar. 5, 1996—Abstract.
Patent Abstracts of Japan, vol. 096, No. 007, Jul. 31, 1996 (Jul. 31, 1996) and JP 08–072270 (Fuji Photo Film Co., Ltd.), Mar. 19, 1996—Abstract.

* cited by examiner

*Primary Examiner*—N. Le
*Assistant Examiner*—K. Feggins
(74) *Attorney, Agent, or Firm*—Frishauf, Holtz, Goodman, Langer & Chick, P.C.

(57) ABSTRACT

A printing tape cassette contains a printing medium tape wound around a reel and held so that its coloring layers appear outside. The coloring layers are colored in different colors at corresponding temperatures and fixed by fixing rays of different wavelengths. The cassette is a substantially square box made of a ray cutting material. The cassette is set on a printer and has a slit-like port through which the printing tape is fed out, a window which cuts the fixing rays and through which window the printing tape accommodated in the cassette is confirmable visually. The printer comprises a reel drive shaft, a platen roller, a guide plate, a tape sensor, a thermal head, a ray cutting shutter, a fixing ray irradiator and a cutter.

16 Claims, 25 Drawing Sheets

TAPE PRINTERS AND PRINTING MEDIUM CONTAINING CASSETTES

BACKGROUND OF THE INVENTION

The present invention relates to tape printers which form a full color image on a heat-sensitive ray-responsive printing medium which is colored with heat energy and whose coloring is stopped by irradiation of rays of a specified wavelength, and a printing medium containing a cassette settable in such tape printer.

Conventionally, various printing systems have been proposed. Typical printing systems put to practical use in offices or households at present are an electronic photograph system, an ink-jet system, and in thermal system.

Recently, the demand for a color printing image has increased. Any one of the above-mentioned printing systems has improved in various respects so as to satisfy the demand for a color printing image and its printing quality has reached a sufficiently practical level. Recently, in addition to improvements to the printing quality, further inexpensive printing devices are desired.

A dominant printing method employed at present in the respective printers of the above systems is to use a cut sheet of paper to print data on it and not to print vouchers/added-up data mainly on continuous paper as in the past, from a standpoint of high speed printing and document printing. Among the above printing systems, printing mechanisms of the thermal system are very frequently incorporated into printers which are intended for cost reduction or into printers enough to perform small-sized printing because the structure of their thermal heads which perform printing is simple.

The printers of the thermal system include ones of a heat-transfer system using an ink ribbon and of a heat-sensitive system using heat-sensitive paper used generally, for example, in fax. The printers of the heat transfer system are mainly employed for color printing. However, in the case of the printers using an ink ribbon, generally, its printing rate is about 5% even when sentences are printed, for example, using a monochromatic (for example, black) ink ribbon, so that 95% of the ink ribbon is discarded without being used. Thus, the ink ribbon is wastefully used. Much more in the color printing, the respective colors of a plurality of color ink ribbons have been used only partially as the colors of the whole paper surface and discarded, so that the ink ribbons have been given a wide berth as producing very much waste. Recently, the ink-jet systems have gained power as simple color printers, but must be improved in terms of oozing and drying of the printing ink.

In such background, a new printing system which records (forms) a full color image, using a printing medium which includes three (yellow, magenta, cyan) heat-sensitive coloring layers formed on an appropriate sheet-like base material on the basis of the above-mentioned heat-sensitive system, is proposed by Japanese Patent Publication Tokkohei 4-10879 and 6-51425, and put partially to practical use. The yellow or magenta coloring layer includes a color former coated uniformly on a base material. The color former includes a dispersed phase in which compounds containing in molecules active methylene called a coupler and a diazonium salt exist in a mixed manner as particles on the order of micron. The couplers are activated by heat of a predetermined temperature or more so that the compounds and the diazonium salt react in a basic atmosphere to form a yellow or magenta coloring matter. The diazonium salt is dissolved with rays of a specified wavelength (ultra-violet rays) to lose the function of reacting with the couplers. The cyan coloring layer includes a color former coated uniformly on the base material, the color former including a dispersed phase in which particles of leuco coloring matters on the order of micron and developers exist in a mixed manner. This cyan layer reacts with the aid of heat of a predetermined temperature or more to be colored.

FIG. 25 shows one example of conventional heat-sensitive recording devices (printers) which form an image on the above-mentioned printing medium (heat-sensitive ray-responsive recording paper), disclosed in Japanese Patent Publication Tokkohei 6-51425.

In the heat-sensitive recording device of FIG. 25, a roll of recording paper 1 is brought at a portion 1' into close contact with the peripheral surface of a drum 3 through a paper feed roller 2, and the recording paper portion 1' is then carried by the drum 3 in a direction of arrow n or r below a thermal head 4 and a light source unit 5. The thermal head 4 extends in the form of a line along the longitudinal axis of the drum 3 (perpendicular to the face of the FIG. 25 sheet). The light source unit 5 includes in a housing 5*a* a light source 5*b* which emits rays in a predetermined frequency band and a filter 5*c* provided below the light source 5*b* which selects rays of each of different wavelengths corresponding to yellow and magenta to irradiate the recording paper with the rays. Feed rollers 6, a cutter 8 and a discharged paper tray 7 are provided to the right of the dram 3.

FIG. 23 is a cross-sectional view of recording paper used in the heat-sensitive recording device. FIG. 24 shows the relationship between the coloring density of each of the coloring layers of the recording paper and heat energy applied to that coloring layer.

The recording paper 1 of FIG. 23 is of a heat-sensitive ray-responsive type and includes paper of three heat-sensitive coloring layers; that is, a yellow layer 1—1, a magenta layer 1-2, a cyan layer 1-3 layered uniformly on a sheet-like supporting base material 1-4 with a heat-resistive protective layer 1-5 provided on the yellow layer 1—1. In each of the yellow, magenta, and cyan layer 1—1, 1-2 and 1-3, its main coloring materials contained in small heat-responsive capsules of a diameter of about 1 $\mu$m are distributed along with other components in a binder material. As shown in FIG. 24, in order to control coloring of three primary colors with heat energy, the heat sensitivities of the respective couplers are designed so as to decrease in order of yellow (Y), magenta (M) and (C) layers (that is, the yellow layer is colored at the lowest temperature) to thereby record image data on the basis of coloring of yellow, magenta and cyan. However, if such heat sensitivity differences are only provided for the respective layers, and even when, for example, only magenta is intended to be colored, magenta as well as yellow would be colored because heat energy required for coloring the magenta will necessarily color even yellow which requires less coloring heat energy than the magenta. Thus, a desired color cannot be obtained. In order to avoid this problem, the upper two layers contain in a mixed dispersed manner components that prevent the upper two layers from being colored by the respective next higher coloring heat energy after the upper two layers are respectively colored, or nullify their colorability by respective rays of specified wavelengths (ultraviolet rays), that is, fix their colored states.

Thus, first, in FIG. 25, the thermal head 4 selectively produces a heat quantity suitable for a coloring layer which is colored at the lowest temperature (ordinarily, the yellow coloring layer) while coloring a corresponding (yellow) image on a recording paper portion 1' carried in the direction of arrow n by a forward rotation of the paper feed roller 2. The roller 2 then feeds out the recording paper 1 until the recording paper portion on which the (yellow) image has been colored reaches at its trailing end a position below the power source unit 5. The paper feed roller 2 is then rotated in a reverse direction to carry the recording paper 1' in the direction of arrow r while the light source 5*b* emits with ultraviolet rays of a specified wavelength whose emission peak is 420 nm onto the first layer (yellow colored layer) of the just colored recording medium paper portion through the filter 5*c* from the light source 5*b,* the ultraviolet rays acting only on the first layer, to dissolve the (yellow) color former so that no more (yellow) color former thermally reacts, that is, to stop the coloring of the background of the (yellow) colored image to thereby fix the (yellow) image. The recording paper portion 1' is carried intact reversely in the direction of arrow r to the position where the (yellow) image started to be colored.

Then, the paper feed roller 2 is again rotated in the forward direction to carry the recording paper portion 1' in the direction of arrow n while the thermal head 4 is selectively producing a heat quantity suitable for a layer colored at the second lowest temperature (ordinarily, the magenta's coloring layer) to color a corresponding (magenta) image on the recording paper portion 1'. Also, in this case, the recording paper portion 1' on which the (magenta) image has been colored is fed out so that the trailing end of the image reaches below the light source unit 5. Then, the paper feed roller 2 is rotated in the reverse direction to carry the recording paper portion 1' reversely in the direction of arrow r while the light source unit 5 is irradiating only the second just colored (magenta) layer with ultraviolet rays of a specified wavelength (whose emission peak is at 365 nm) to dissolve the (magenta) color former so that no more (magenta) color former performs a heat-sensitive reaction or that the coloring of the background of the colored (magenta) image is stopped to thereby fix the (magenta) image superimposed on the previously formed (yellow) image. The recording paper portion 1' is then carried reversely or in the direction of arrow r to the position where the recording paper portion 1' started to be colored first (or where the yellow image was colored).

Then, the paper feed roller 2 is also rotated forwardly to carry the recording paper portion 1' in the direction of arrow n while the thermal head 4 is selectively producing a large quantity of heat suitable for the last (ordinarily, cyan (C)) coloring layer to form a corresponding (cyan) image on the two already fixed (yellow and magenta) images in the superimposing manner to thereby produce a full color image.

As described above, the recording paper portion 1' on which the full color image has been formed is carried intact in the direction of arrow n, moved away from the drum 3 by the feed rollers 6 provided downstream in the carrying direction, and then sent to the discharged paper tray 7. The recording paper 1' is then cut by the cutter 8 provided upstream of the discharged paper tray 7, and piled on the discharged paper tray 7. The heat-sensitive recording device disclosed in this prior art discloses the principle of the recording method, but not control for irradiating the recording paper portion 1' with accurately from the light source unit 5 and a method for avoiding exposure of an unused portion of the recording paper 1, and various problems to be solved for putting the device to practical use still remain.

Printers which utilize the convenience of the thermal type printers and which are intended to be used in a different manner from that of the above printers have appeared and started to be used widely as business or household ones. These printers each comprise an input unit, a display unit and an output unit so that characters are printed on a long printing medium tape wide about 10–50 mm with an ink ribbon. Generally, a tape cassette which contains a set of such printing medium tape and ink ribbon, as mentioned above, is removably set on each such printer in use.

FIG. 26 shows a main portion of such conventional tape printer in a cross-sectional view in which a tape cassette 12 set in a tape cassette accommodating space 11 in the tape printer 10 comprises a paper reel 13, a ribbon feed reel 14 and a ribbon winding reel 15 with a printing paper tape 16 in the form of a roll formed around the paper reel 13 and an ink ribbon 17 in the form of a roll formed around the ink ribbon feed reel 14. The paper reel 13 is engaged in its hole 13*a* over a paper reel drive shaft of the printer to be rotated forwardly or backwardly (clockwise or counterclockwise in FIG. 26). The ribbon winding reel 15 is engaged in its hole 15*a* over a winding reel drive shaft of the printer to be rotated forwardly (clockwise or in the paper carrying direction in FIG. 26).

The ribbon feed reel 14 is engaged over a brake shaft of the printer so that its rotation is braked as requested. A pair of cutting blades 18*a* and 18*b* is provided each on a respective side of a paper discharge port provided on the right-hand side of the cassette accommodating space 11 (FIG. 26) in the tape printer 10 to cut away the printed paper portion 16' to be discharged to the outside.

When the tape cassette 12 is set on the printer, as shown in FIG. 26, the thermal head 21 fixed and supported at one end of a bracket (not shown) of the printer body is inserted into a recess 19 formed in the tape cassette 12. The thermal head 21 turns counterclockwise around a pin 21*a* within the recess 19 by the counterclockwise turning operation of the bracket to press the paper 16 and ink ribbon 17 against the platen 22 whereas the thermal head 21 turns clockwise to move away from the printing position in the non-printing operation.

The paper 16 is fed out from the paper reel 13 into the printing section where the thermal head 20 and the platen 22 face each other. The ink ribbon 17 is pulled out from the ribbon feed reel 14 by the winding operation of the ribbon winding reel 15 to extend under the paper 16 across the recess 19 and a printing ink in the ribbon is transferred by the thermal head 21 to the paper 16. The paper 16 on which an image is now formed with the transferred ink is then discharged as the printed paper portion 16' to the outside and cut away in an appropriate length by the pair of cutting blades 18*a* and 18*b*.

The printed paper (tape), as shown in an enlarged broken line circle A in FIG. 26A, usually has an adhesive layer b and a peelable paper strip c provided on a back of a printing medium a. By removing the peelbable paper strip c from a cut printed tape 16', the printed tape can be pasted, for example, on one of user's belongings, a book, a video cassette or a locker at a desired position in use.

Generally, the tape cassettes 12 used widely comprise a combination of a predetermined background color tape (usually, a resin film tape) and a monochromatic (for example, black) ink ribbon. Recently, tape cassettes which each contain a multi-colored ink ribbon have appeared so as to satisfy a demand for color printing.

Even with such tape cassette, production of waste of ink ribbons cannot be avoided. Tape printing, however, has been accepted because the quantities of paper and ink used are not so large as a whole. With such tape printers, a combination of tape and ink ribbon is used. Thus, although the quantity of paper and ink used is small, the tape and ink ribbon are designed so as to be both used up simultaneously in length in consideration of economic efficiency. However, it is substantially impossible that both the tape and ink ribbon are used up simultaneously as designed because of various mistakes or accidents occurring in use mainly on the user side, and hence the production of tape or ink ribbon waste cannot be avoided.

In such tape printer, a quantity of tape contained in the tape cassette decreases because of a space which the ink ribbon occupies in the tape cassette. Thus, a frequent exchange of a tape cassette is compelled. Although separate setting and removal of the tape and ink ribbon has been proposed, the composition of a mechanism for this operation as well as their handling is complicated and troublesome. Thus, it is not practical.

Since the tape printer of this type prints characters with the thermal head, it can use heat-sensitive paper like a FAX device. In that case, a tape cassette which only contains a printing tape without an ink ribbon may be used, and hence it seems that the above problem is solved. Since there are actually no heat-sensitive tapes which satisfy color printing sufficiently, the printer cannot form a satisfactory color image. Thus, the color ink ribbon system has been established for the color orientation and it is impossible to grow out of the color ink ribbon system. Furthermore, there have been no ideas themselves which solve the above problems.

When a new printing system is employed, especially in a tape printer, proper design is required to adjust the new printing system to the structure of the printer based on special specifications for the tape printing. More particularly, if the above-mentioned various problems are considered, it seems to be a first step of solving the problem to use a printing system based on the above-mentioned heat sensitive system. However, mere employment of new materials will not suffice, but there are various problems to be solved such as ray irradiation control, a method of mounting a printing mechanism, a tape carrying mechanism, its control method, a tape cassette structure, etc., for putting the tape printer to practical use.

SUMMARY OF THE INVENTION

It is therefore an object of the present invention to provide an economical, small, inexpensive, practical, excellent-operability tape printer which is free from the drawbacks of the above tape printer and prints characters on a heat-sensitive ray-responsive printing medium.

In order to solve the above object, the present invention provides a tape printer comprising:

a printing tape cassette which includes a case with a port on one side of said case, and a long printing medium tape contained in the case so as to be passable through the port, the tape including a plurality of coloring layers formed on a surface of a support base and colored as different colors at different temperature and fixed by irradiated fixing rays of different wavelengths, and a peelable paper piece provided on a back of the support base through an adhesive layer;

a cassette accommodating space which accommodates the printing tape cassette removably;

tape conveying means for performing forward conveyance of the printing medium tape which includes feeding out the printing medium tape from the case through the port and for performing backward conveyance of the printing medium tape which includes rewinding the tape into the case;

a thermal head which thermally prints an image on the printing medium tape conveyed by the tape conveying means through the width of the printing medium tape;

input means for inputting image information on an image to be formed on the printing medium tape;

thermal head drive controlling means for driving the thermal head at a plurality of different temperatures on the basis of the image information input by the input means when the tape conveying means performs the forward conveyance of the printing medium tape a corresponding plurality of times to sequentially color the plurality of coloring layers in a corresponding plurality of colors in the same area of the printing medium tape;

fixing ray irradiating means for irradiating sequentially the printing medium tape with a plurality of fixing rays of different wavelengths corresponding to the plurality of coloring layers of the printing medium tape after the respective corresponding driving operations of the thermal head to fix the respective produced colors of the coloring layers;

irradiation range limiting means for limiting a range of irradiation of the fixing rays of the different wavelengths by the fixing ray irradiating means to a predetermined range of the printing medium tape; and fixing range controlling means for controlling a quantity of conveyance of the printing medium tape by the tape conveying means and the operation of the fixing ray irradiation means so that the fixing rays of the different wavelengths are not emitted on an upstream side of the printing medium tape from the same area in the direction of forward conveyance of the printing medium tape. Thus, the range of fixing rays emitted on the printing medium tape is accurately limited by the irradiation range limiting means and the fixing range control means. Therefore, a preferable color printer is provided which eliminates a waste of the printing medium tape due to useless exposure of the printing tape.

In the tape printer, the operation of the fixing ray irradiating means may be controlled in the course where the forward or backward conveyance of the printing medium tape is performed.

In the tape printer, the irradiation range limiting means may comprise a movable shutter means. The tape printer may comprises means for moving the thermal head into contact with and away from the printing medium tape, and an interlocking mechanism for interlocking operation of the shutter means with the movement of the thermal head into contact with and away from the printing medium tape. This interlocking mechanism ensures setting the limitation of the irradiation range by the shutter means, the timing of start of the ray fixation, and the range of the printing medium to be irradiated with the rays.

In the tape printer, the irradiation range limiting means may comprises a cover with a slit therein through which the fixing rays are allowed to pass only in a predetermined direction. The limitation of the irradiation range by the slit serves to simplify and miniaturize the printer.

In the tape printer, the tape conveying means may convey the printing medium tape until its leading end fed out from the case when the printing starts reaches a position beyond the thermal head in the direction in which the forward conveyance of the printing medium tape is performed; and the thermal head drive control means may drive the thermal head after the printing medium tape is conveyed by the tape conveying means to color the image for the image information input by the input means in an area of the printing medium tape subsequent to its leading end portion.

The tape printer may further comprise cutter means for cutting the leading end portion of the printing medium tape conveyed by the tape conveying means. As described above, exclusion of the end portion of the printing medium tape from the range of printing serves to form an excellent color image even after the printer is at a stop for a long time.

The tape printer may further comprise tape sensing means for sensing a portion of the printing medium tape fed out from said case, and wherein:

the tape conveying means may be responsive to the sensing of the printing medium tape by the tape sensing means to automatically return into the case the portion of the printing medium tape fed out from the case when the printing tape cassette is removed from the cassette accommodating space or when a series of printing operations concerned has been completed. By automatically returning the printing medium tape into the case at all times on the basis of the tape sensing, useless exposure of the printing tape fed out from the case is prevented.

In the tape printer, the case may be made of a material which cuts the fixing rays and has a window which cuts the fixing rays and through which a possible printing medium tape present within the case is confirmed visually. The printing tape cassette may contain a reel around which the printing medium tape is wound so that its printing surface faces outward.

The tape printer may further comprise a pair of conveyance rolls provided in the vicinity of the port and engaged with the tape conveying means for holding the printing medium tape therebetween to aid in its conveyance and also for functioning as a ray cutting material which prevents the printing medium tape from being exposed to the fixing rays entering the case through the port.

The case may take the form of a substantially square box with the port provided on a corner of a side thereof.

In order to achieve the above object of the present invention, the present invention provides a printing medium accommodating cassette removably set on a printer which comprises a thermal head for applying heat energy based on image information to a printing medium contained in a case to color the printing medium, the tape including a plurality of coloring layers formed on a surface of a support base and colored as different colors at different temperature and fixed by irradiated fixing rays of different wavelengths, a peelable paper piece provided on a back of the support base through an adhesive layer and fixing ray emitting means for emitting the fixing rays onto the colored printing medium to fix the color produced on the printing medium, the cassette comprising:

a case made of a materiel which cuts the fixing rays, the case having a port through which the printing medium is passable, and a window which cuts the fixing rays and which allows the printing medium contained in the cassette to be confirmed visually.

The ray cutting material of the case and the structure of the window are helpful in storing the ray-sensitive printing medium within the cassette and also facilitate confirmation of a quantity of the printing medium used.

In the printing medium accommodating cassette, the printing medium may take the form of a long tape, and further comprise a reel around which a printing medium tape is wound and held.

The printing tape may be wound around a reel so that its printing surface faces outward.

When the printing medium tape is pulled out from the cassette case, the inside of the wound printing medium tape is usually rubbed with the cassette case in the conventional manner. Thus, coloring of the tape may occur due to the rubbing heat. In contract, in the present invention, since the medium tape is wound so that its printing surface may face outward, the coloring is avoided.

The tape cassette may further comprise a pair of conveyance rolls provided in the vicinity of the port of the case and engaged with said tape conveying means of the printer for holding the printing medium tape therebetween to aid in its conveyance and for functioning as a ray cutting material which prevents the printing medium tape from being exposed to the fixing rays entering the case through the port. Insertion of the pair of conveyance rolls within the printing tape cassette contributes to stabilized tape conveyance.

In the tape cassette, the case may take the form of a substantially square box with the port provided on a side thereof. Thus, a small inexpensive tape printer is provided.

BRIEF DESCRIPTION OF THE DRAWINGS

One aspect and other features of the present invention will be clarified with the following detailed description when take along with the accompanying drawings.

FIGS. 1B1 and 1B2 are enlarged views of the sensor of FIG. 1B;

DESCRIPTION OF THE PREFERRED EMBODIMENTS

Embodiments of the present invention will be next described next with respect to the accompanying drawings.

First Embodiment

Figure 1A:
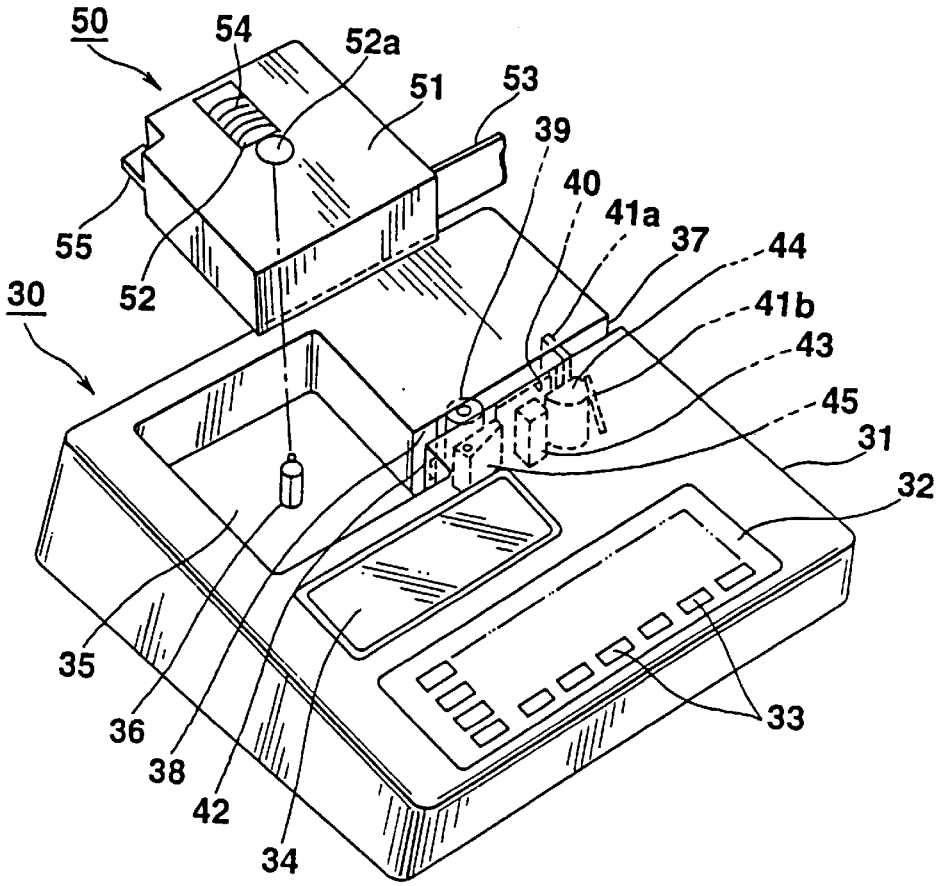
FIG. 1A is a simplified perspective view of a printer as a first embodiment of the present invention and a tape cassette set on the printer.

Shown in a simplified perspective view of FIG. 1A are a printer as a first embodiment of the present invention and a printing tape cassette set on the printer. The tape cassette of FIG. 1A is also shown in a plan view in FIG. 1B.

Figure 1B:
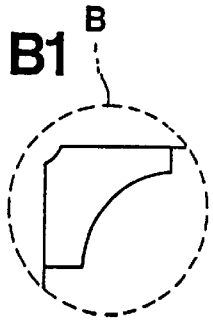
FIG. 1B is a plan view of the tape cassette of FIG. 1A.
Figure 1B:
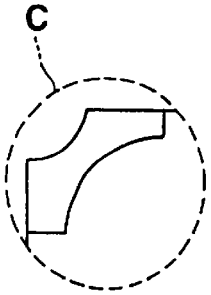
Figure 1B:
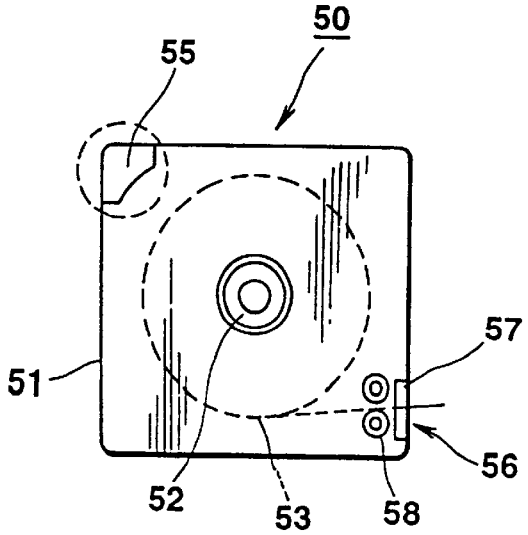
Figure 2C:
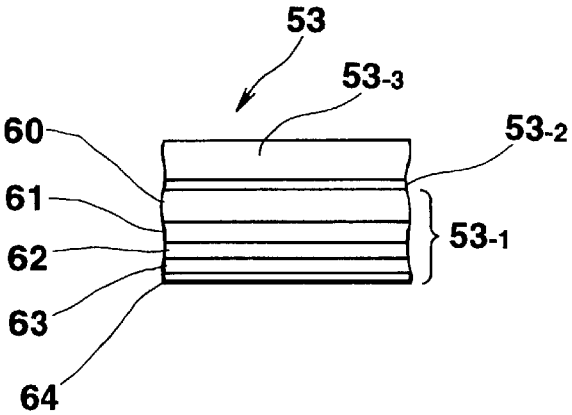
FIG. 2C is a cross-sectional view of the printing tape of FIG. 2B.
Figure 2B:
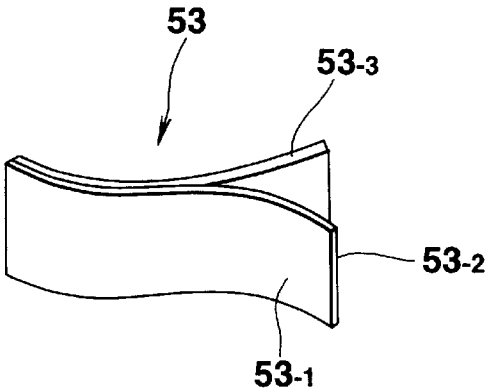
FIG. 2B is a perspective view of a printing tape used in the first embodiment.
Figure 2A:
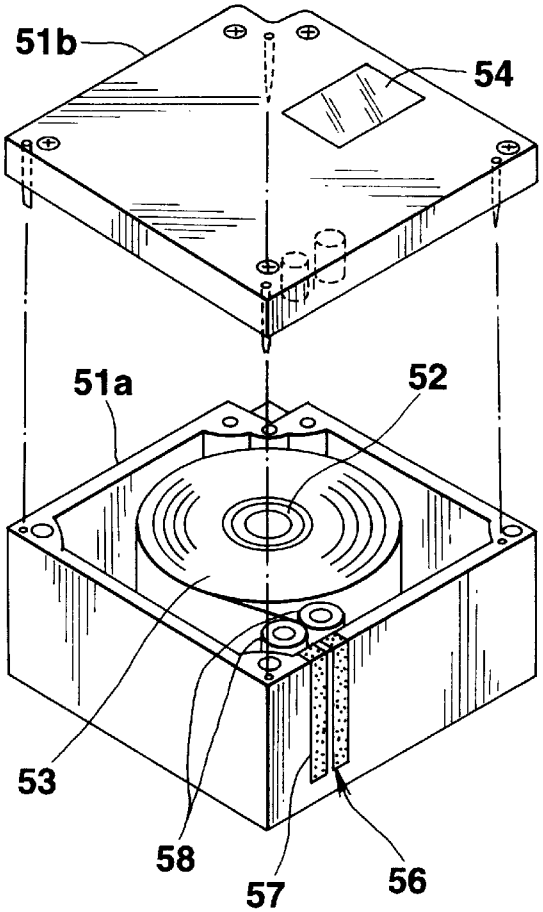
FIG. 2A is an exploded perspective view of the tape cassette of FIG. 1B.

FIG. 2A is an exploded perspective view of the tape cassette of FIG. 1B. FIG. 2B is a perspective view of a printing tape used in the first embodiment. FIG. 2C is a cross-sectional view of the printing tape of FIG. 2B.

As shown in FIG. 1A, the printer 30 includes a key-in unit 32 in a lower portion of an inclined upper surface of a housing 31. The key-in unit 32 is provided with a plurality of keys 33 which includes cursor keys, Japanese kana and alphanumeric character input keys, Chinese character conversion keys, a print key, and an enter key. A liquid crystal display (LCD) unit 34 is provided on the other side of the key-unit 32 on the upper surface. A tape cassette accommodating space 35 is provided on the other side of the LCD unit 34. In FIG. 1A, the tape cassette accommodating space 35 is shown by removing its cover so that the inside of the space 35 can be seen well. The cover is sized so as to cover the accommodating space 35 as well as a tape conveyance path 38.

The cassette accommodating space 35 is substantially square in which a substantially upstanding reel drive shaft 36 (tape conveying means) is provided at substantially the center of the space. A conveyance path 38 extends from a lower right-hand side of the accommodating space 35 to a tape discharge port 37 which is open to an outer side of the housing 31. Some devices shown by broken lines are provided on each side of the conveyance path 38.

A platen roller 39, a guide plate 40 and a fixed blade 41*a* of a cutter 41 are disposed in this order on the other side of the conveyance path 38 from its upstream to its downstream side. A tape sensor 42 (tape sensing means), a thermal head 45, a ray cutting shutter 43 (ray shielding means), a fixing ray irradiator 44 (fixing ray-irradiating means), and a movable blade 41*b* of the cutter 41 are disposed in this order on the other side of the conveyance path 38 from its upstream side to its downstream side.

The tape cassette 50 has no ink ribbon, but as shown in FIG. 2A, only a printing (medium) tape 53 accommodated within a case 51 in the form of substantially square box 51*a* with a cover 51*b*. The printing tape 53 is wound around a reel 52.

As will be described in detail later, the printing tape 53 includes a heat-sensitive ray-responsive recording medium whose coloring is stopped by fixing rays (ultraviolet rays having a specified wavelength whose emission peaks are at 420 and 365 nm) irradiated from the fixing ray irradiator 44. The ultraviolet lays themselves are produced along with visible rays in an ordinary environment. Thus, even if a tape cassette 50 is set in the printer 30 and covered with the cover (not shown), the printing tape 53 within the tape cassette 50 is gradually exposed naturally to irradiated rays when the tape is not used for a long time. Of course, this applies when the tape is stored within the tape cassette by itself.

In order to avoid useless exposure of the printing tape 53 before its use, in the present invention, the case 51 of the tape cassette 50 is composed of a material which cuts at least the ultraviolet rays of the same wavelengths as the fixing rays. Especially, the cover 51*b* is composed of a material which also cuts the ultraviolet rays (rays of a wavelength of substantially less than 450 nm) and has a window 54 made of a transparent resin (which cuts UV) through which the inside of the case is visible. Thus, the remaining quantity of the printing tape 53 present within the case 51 can be known. In order to completely prevent natural exposure of the tape, the reel 52 is preferably made of a material which cuts the ultraviolet rays which enter along end portions of the tape exposed outside the reel 52 and through a reel hole 52*a*.

When the tape cassette 50 is set within the tape cassette accommodating space 35 in FIG. 1A, the reel drive shaft 36 of the printer 30 is engaged in a hole 52*a* in the reel 52 around which the printing tape 53 is wound.

A corner of the tape cassette 50 positioned to the left of the window 54 is cut so that a plate-like cassette type sensor 55 is formed, as shown in FIG. 1A. As shown by a broken circle B (FIG. 1B1) or C (FIG. 1B2), a corner of the plate-like sensor 55 is cut arc-concave. The size of the arc concavity (radius of the arc) corresponds to a type of the tape cassette 50, which is classified according to the width of the printing tape 53 enclosed within the case 51. When the tape cassette 50 is set within the cassette accommodating space 35, the detector (not shown) detects the size of the arc concavity of the cassette type sensor 55 to automatically recognize the type of the set tape cassette 50 or the width of the printing tape 53 accommodated within the tape cassette, for example, as 20 or 50 mm wide.

As shown in FIGS. 1B and 2A, a slit-like printing tape feeding port 56 is formed at a corner of the cassette opposite the cassette type sensor 55 corner, as shown in FIGS. 1B and 2A, so that the printing tape 53 may be fed or returned through the port 56 outside or into the cassette. The port 56 is provided with a sealing material 57 made of felt or sponge which prevents external dust and rays from entering the cassette through the port, but which has a slit through which the printing tape 53 is allowed to pass to the outside or into the case 50. A pair of conveyer rolls 58 is provided close to the sealing material 57 within the case 51 to assist in the conveyance of the printing tape 53 and also functions as a ray cutting member because the rolls 58 press against each other.

The tape 53 accommodated within the tape cassette 50 is fed out through the port 56, printed, which will be described in detail later, and then cut by the cutter 41 (fixed and movable blades 41*a* and 41*b*) as shown in FIG. 2B. As shown in FIGS. 2B and 2C, the printing tape 53 is composed of a printing layer 53-1, an adhesive layer 53-2 formed on the back of the printing layer 53-1, and a peelable paper sheet 53-3 covering the adhesive layer 53-2.

As shown in FIG. 2C, the printing layer 53-1 is composed of a support layer 60 provided on the back of the adhesive layer 53-2, a cyan (C) layer 61, a magenta (M) layer 62, and a yellow (Y) layer 63 as the respective heat-sensitive coloring layers and a heat resisting protective layer 64, to which heat energy is applied, provided in this order on the support layer 60. The yellow, magenta and cyan layers 63, 62 and 61 are colored differently at respective different temperatures. The yellow and magenta layers 63 and 62 are deprived of their colorability by (ultraviolet) rays of different wavelengths and fixed. The heat-resisting protective layer 64 has high permeability so that rays of a wide range of wavelengths are allowed to pass therethrough with minimum attenuation. Thus, the printing tape 53 is heat-sensitive ray-responsive as a whole.

The printing tape 53 is preferably wound around the reel 52 with the heat resisting protective layer 64 (the printing surface or ray fixing surface) facing outward in order to avoid rubbing of the printing surface of the tape 53 with the tape cassette 50 to thereby cause the printing surface to be colored with produced frictional heat if the tape is rewound with its printing surface facing inward.

Figure 3B:
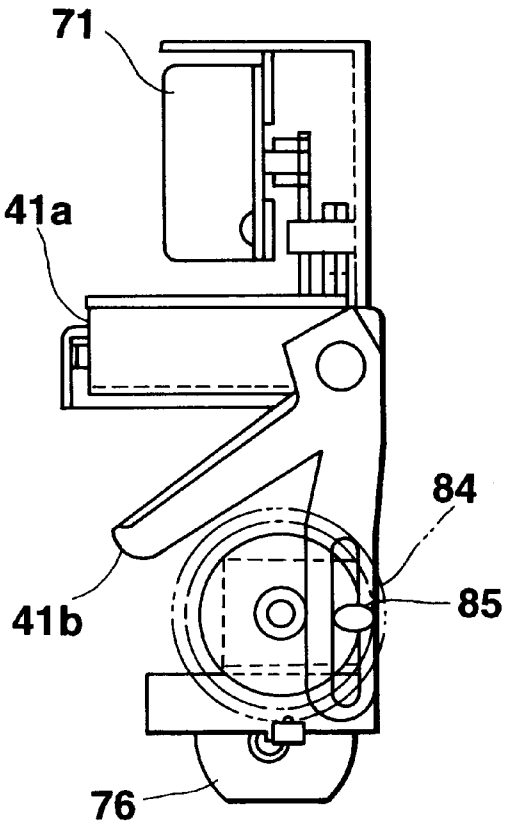
FIG. 3B is a side cross-sectional view of FIG. 3A.
Figure 3A:
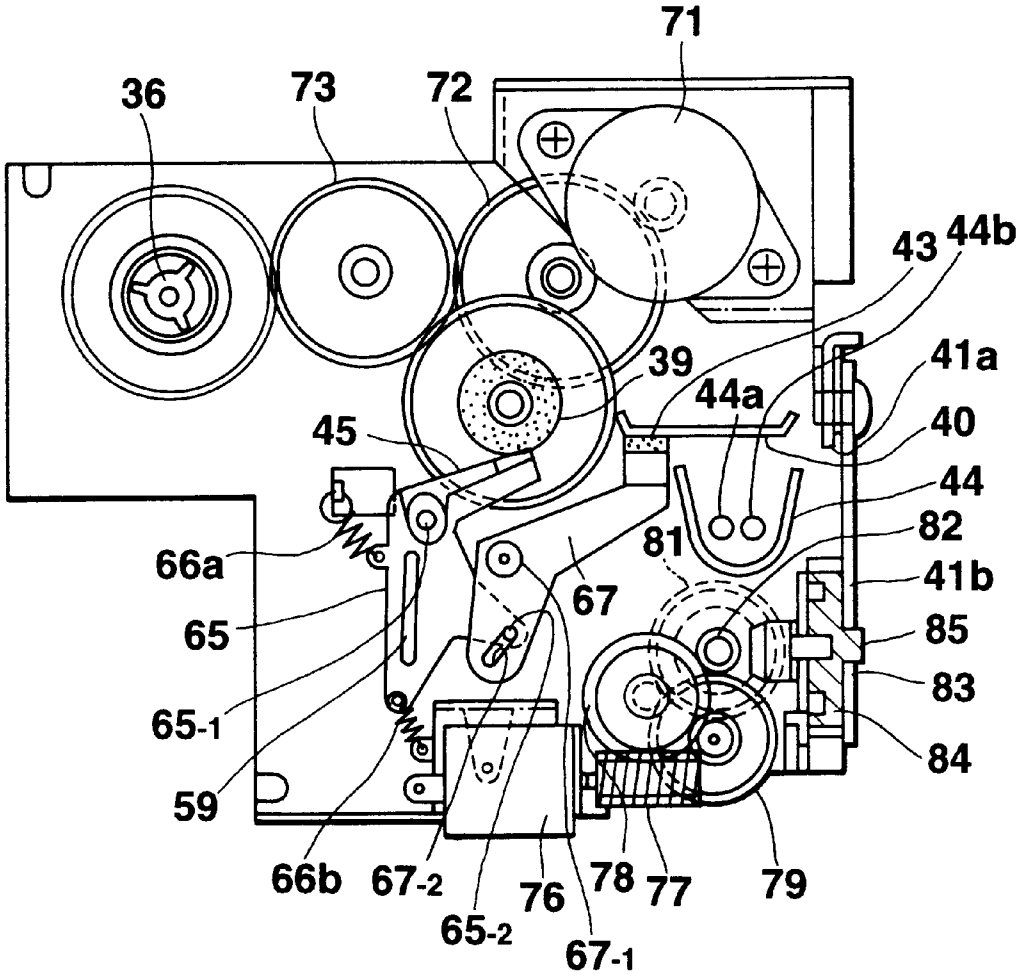
FIG. 3A illustrates a drive mechanism for the respective elements of the printer of FIG. 1A.

FIG. 3A shows a drive mechanism for the respective elements of the printer of FIG. 1A. The drive mechanism is disposed in the tape cassette accommodating space 35 in the housing 31 of FIG. 1A and an area present to the right of the LCD unit 34 below the upper surface of the printer body. Similar elements of the printers driven by the drive mechanisms of FIGS. 1A and 3A are given the same reference numeral.

As shown in FIG. 3A, the thermal head 45 is integral with a head turning member (supporting means) 65 and supported rotatably at a pivot 65-1. The head turning member 65 has an elongated slot 59 extending downward from the vicinity of the pivot 65-1 in which a cam pin (not shown) switched and driven by a cam crutch (not shown) engaged with a drive system (not shown) is fitted so as to move right and left to thereby turn the head turning member 65 clockwise or counterclockwise.

The head turning member 65 has a rightward extending protrusion with a pin 65-2. By a coil spring 66*a* extending between a frame of the printer body and a point on an edge of the head turning member 65, the head turning member 65 is biased clockwise around the pivot 65-1. By a second coil spring 66*b* extending between another frame of the printer and the lowest end of the head turning member 65, the turning member 65 is biased counterclockwise around the pivot 65-1.

A ray cutting shutter 43 is supported by an end of a right-hand portion of a substantially L-like shutter turning arm 67 turnably supported substantially at its midpoint by a pivot 67-1. A downward extending left-hand portion of the shutter turning arm 67 has therein a slanted slot 67-2 in which the pin 65-2 of the head turning member 65 is slidably fitted. Thus, as will be described later, the shutter turning arm 67 is turned in conjunction with the movement (turning) of the thermal head 45.

Figure 4B:
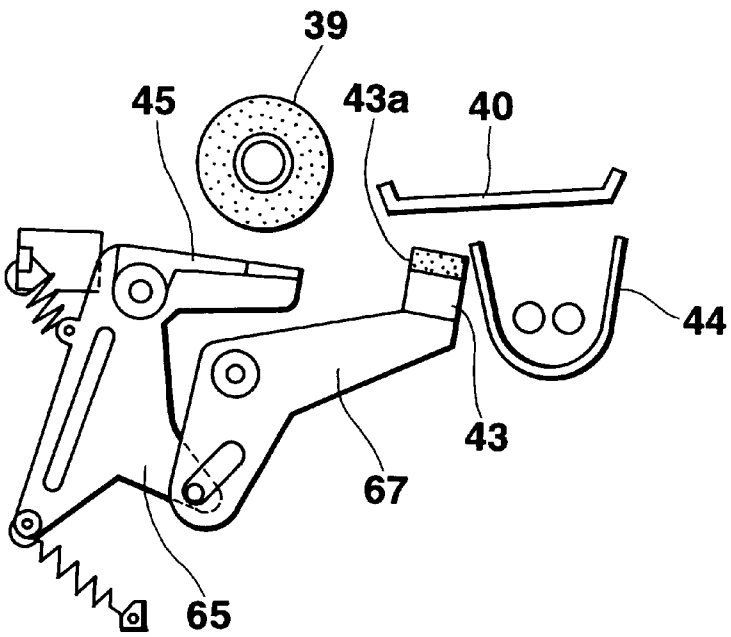
FIGS. 4A and 4B each illustrate operation of a thermal head and a ray cutting shutter driven in interlocking relationship by the drive mechanism of FIG. 3A.
Figure 4A:
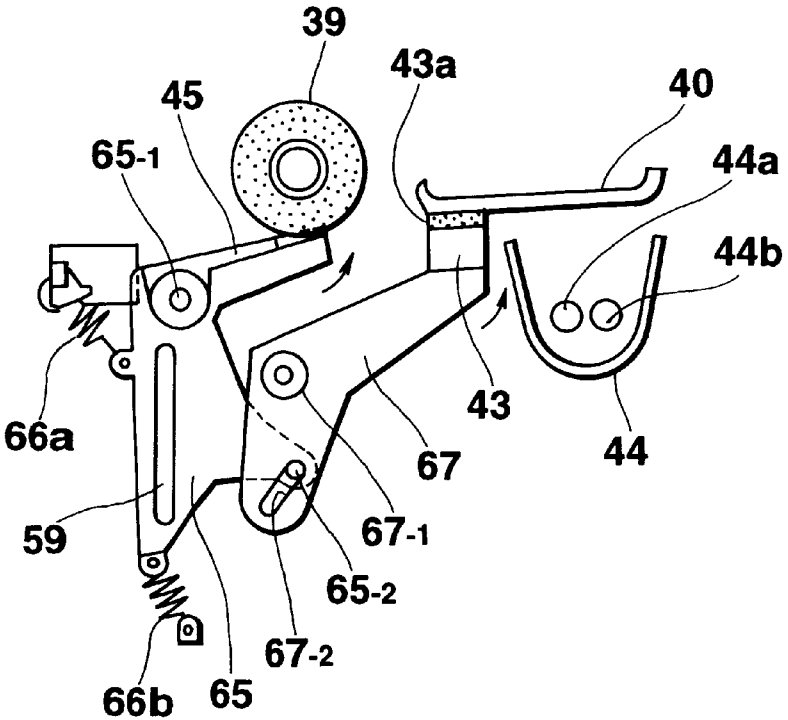

FIGS. 4A and 4B each show the operation of the thermal head 45, ray cutting shutter 43 and their related components of FIG. 3A driven in interlocking relationship by the drive mechanism mentioned above.

As shown in FIG. 4A, when the head turning member 65 is turned counterclockwise, the thermal head 45 supported at the pivot 65-1 is turned similarly counterclockwise to be pressed against the platen roller 39 at the printing position. At this time, the left-hand portion of the shutter turning arm 67 is also turned counterclockwise through a pin 65-2-slot 67-2 connection. That is, the whole shutter turning arm 67 is turned counterclockwise, and hence the end 43*a* of the ray cutting shutter 43 supported by the right-hand portion of the shutter turning arm 67 is turned counterclockwise to be pressed against the guide plate 40 to thereby prevent rays emitted from the fixing ray irradiator 44 from reaching the upstream side of the tape conveyance path.

As shown in FIG. 4B, when the head turning member 65 is turned clockwise, the thermal head 45 is moved away from the platen roller 39 to open the conveyance path. Simultaneously, the left portion of the shutter turning arm 67 is pulled leftward by the pin 65-2 engaged in the slot 67-2 in the left portion of the shutter turning arm 67. Thus, the right-hand portion of the shutter turning arm 67 is turned clockwise, and the end 43*a* of the ray cutting shutter 43 is moved away from the guide plate 40 to open the conveyance path.

The end 43*a* of the ray cutting shutter 43 is made of a soft material such as sponge or felt of a ray cutting property. Thus, as shown in FIG. 4A, when the shutter end 43*a* presses against the guide plate 40, the irradiation rays from the fixing ray irradiator 44 are prevented from irradiating the thermal head 45 side (the printing tape 53 under printing) upstream of the shutter 43.

By an interlocking mechanism including the shutter turning arm 67 and the head turning member 65, the ray cutting shutter 43 is moved depending on the engagement and disengagement of the thermal head 45 with and from the platen roller 39. By pressing against the guide plate 40, the ray cutting shutter 43 accurately limits to within a predetermined range the fixing rays irradiated from the yellow or magenta ray-fixing lamp 44*a* or 44*b* of the fixing ray irradiator 44.

As shown in FIG. 3A, the platen roller 39 is driven along with the reel drive shaft 36 by a motor 71 through idle gears 72, 73, etc. As shown in FIGS. 3A and 3B, the cutter members 41 (41*a* and 41*b*) are opened/closed by a DC motor 76 through a worm 77 provided on a drive shaft of the DC motor 76, a worm wheel 78 meshing with the worm 77, a reduction gear 79 meshing with a smaller diameter gear integral with the worm wheel 78, a spur gear 81 meshing with the small diameter gear, a bevel gear 82 integral with the spur gear 81, a bevel gear 83 meshing with the gear 82, a cutter cam 84 integral with the bevel gear 83, and a pin 85 disposed at a predetermined position along a periphery of the cutter cam 84.

FIGS. 5A–5F each show the basic cutting operation of the printing tape by the cutter cam 84 driven by the DC motor 76 and the movable blade 41*b* of the cutter 41. FIG. 5A again show only the elements of FIG. 3B related to the tape cutting operation.

Figure 5A:
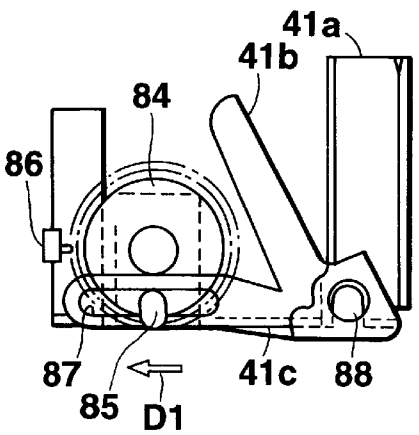
FIGS. 5A, 5B, 5C, 5D, 5E and 5F each illustrate a basic cutting operation of a printing tape by a cutter cam driven by a DC motor and a movable blade of a cutter.

FIG. 5A shows the cutter cam 84 at its reference or home position, which is sensed by a sensing switch 86. In this state, the pin 85 is stopped substantially at a midpoint in the slot 87 in a turning arm 41*c* integral with and open at an acute angle to the movable blade 41*b*, so that the turning arm 41*c* takes a horizontal attitude or is stopped at its reference position. Thus, the movable blade 41*b* is open at a maximum angle to the fixed blade 41*a*.

When the DC motor 76 starts to rotate, the cutter cam 84 and hence the pin 85 rotate clockwise as shown by an arrow D1 of FIG. 5A.

Figure 5B:
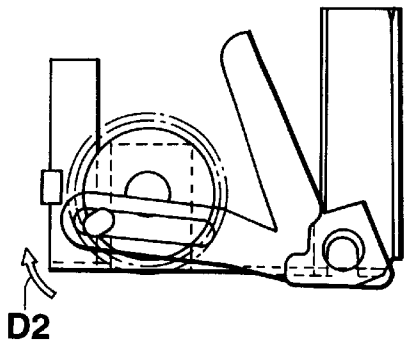
Figure 5C:
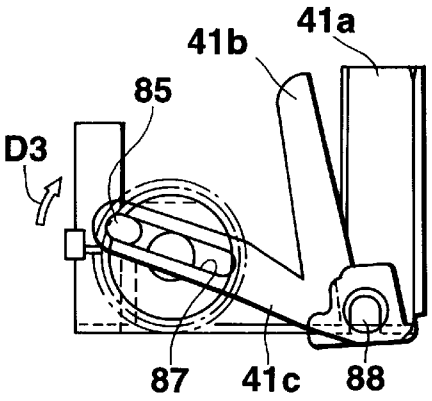

When the turning operation of the pin 85 proceeds, as shown by arrows D2 and D3 of FIGS. 5B and 5C, until it reaches the left end of the slot 87 in the turning arm 41*c*, the movable blade 41*b* which has turned clockwise around the pivot 88 starts to cut away the printed tape in cooperation with the fixed blade 41*a*.

Figure 5D:
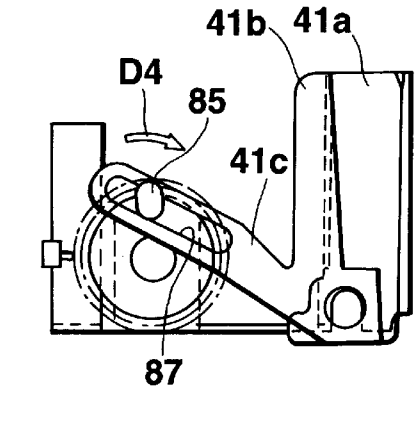

As shown by an arrow D4 of FIG. 5D, by the continuing rotation of the cutter cam 84, the pin 85 further turns to return rightward in the slot 87 to raise the turning arm 41*c* up. Thus, the clockwise turning operation of the movable blade 41*b* further proceeds to thereby close the movable blade 41*b* against the fixed blade 41*a* to thereby terminate the cutting operation by the cutter 41.

Figure 5E:
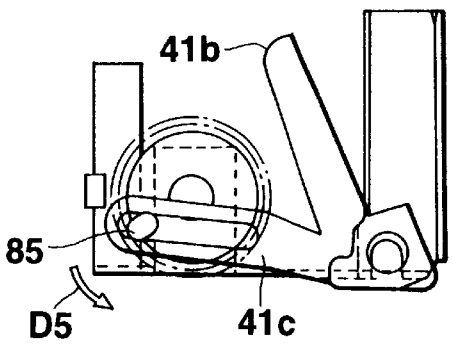
Figure 5F:
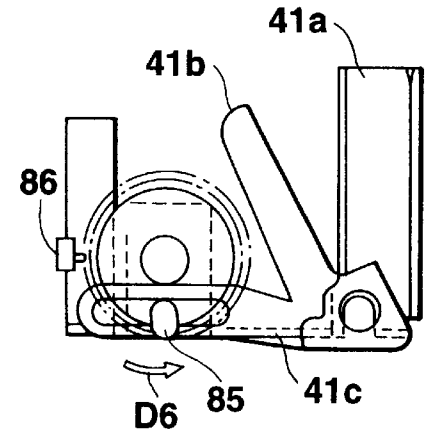

As shown by an arrow D5 in FIG. 5E, the cutter cam 84 then starts to turn reversely. Thus, the pin 85 changes its pushing-up operation performed so far on the turning arm 41*c* to its pushing down operation on the turning arm 41*c*. Thus, the turning arm 41*c* is turned downward and the removable blade 41*b* starts to turn counterclockwise to start opening from the fixed blade 41*a*. As shown by an arrow D6 in FIG. 5F, the pin 85 then reaches the lowest point, and the turning arm 41*c* is pushed down so as to take a horizontal attitude. Thus, the movable blade 41*b* is fully open relative to the fixed blade 41*a*, and hence the whole cutter takes the same initial state (reference position) as in FIG. 5A, whereupon the sensing switch 86 senses this position to stop the cutter at its reference position.

Figure 6:
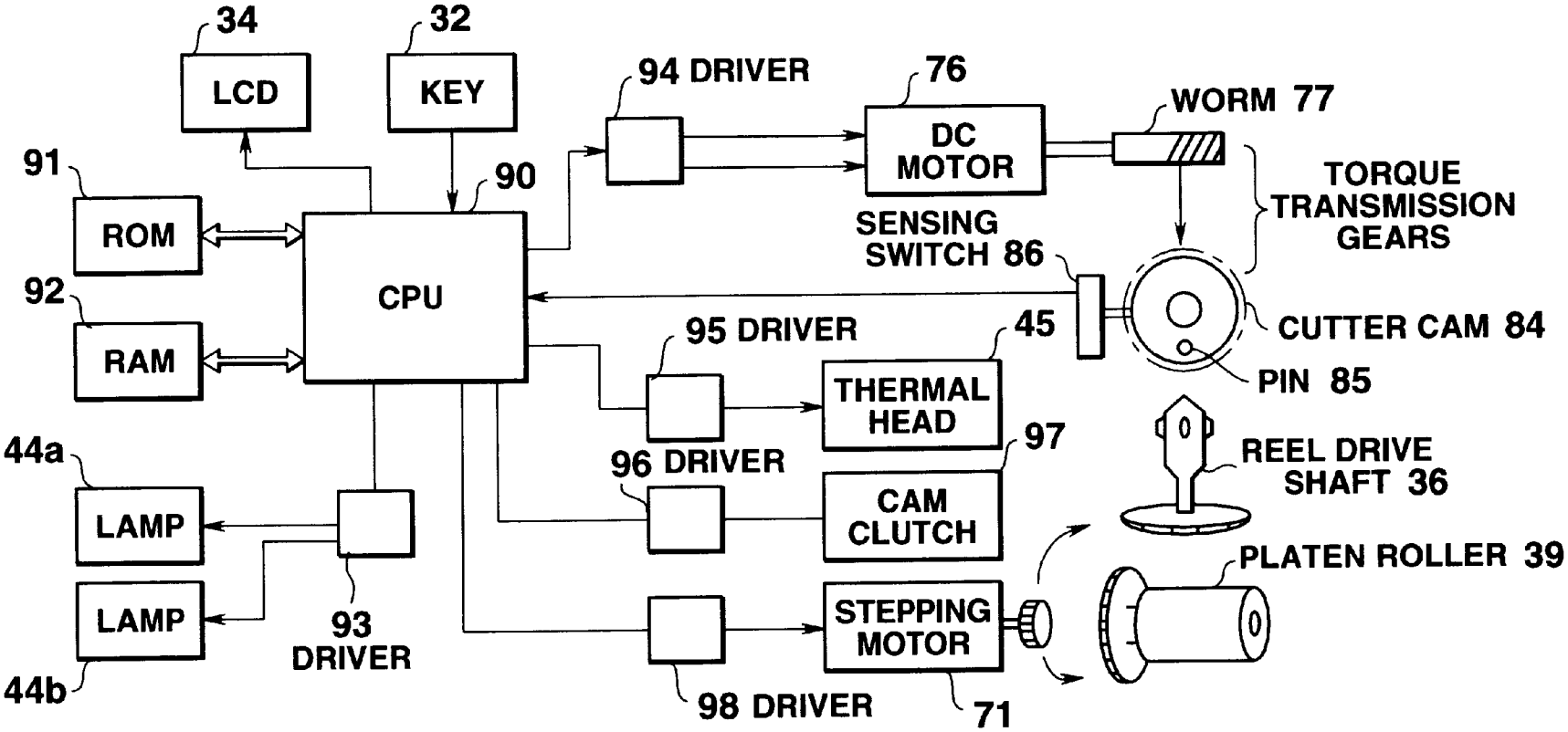
FIG. 6 is a block diagram of a controller which controls operation of the respective elements of the printer in the present embodiment.

FIG. 6 is a block diagram of a controller which controls the driving operation of the respective elements of the printer 30. As shown in FIG. 6, the controller includes a CPU (Central Processing Unit) 90, the key-in unit 32 and LCD unit 34 of FIG. 1A, a read only memory (ROM) 91, a variable memory (RAM) 92, a lamp driver 93, a DC motor driver 94, a thermal head driver 95 and a crutch driver 96. The CPU 90 receives a key operation status signal from an operated key 33 of the key-in unit 32 and a sensing signal indicative of the reference position of the cutter cam 84 from the sensing switch 86.

The CPU 90 outputs a display drive signal to the LCD unit 34, a command signal to the DC driver 94 to rotate the DC motor 76 to drive the cutter 41 through the cutter cam 84, as shown in FIG. 5, a command signal to the thermal head driver 95 to cause the thermal head 45 to produce heat, a command signal to the crutch driver 96 to drive the cam crutch 97 which turns the thermal head 45 and the ray cutting shutter 43, as shown in FIGS. 4A and 4B, a command signal to a driver 98 of a stepping motor 71 to drive the platen roller 39 or reel drive shaft 36, and a command signal to the lamp driver 93 to cause the yellow or magenta ray-fixing lamp 44*a* or 44*b* of the fixing ray irradiator 44 to emit corresponding rays.

The CPU 90 reads a control program stored in the ROM 91, controls a respective one of the elements of the printer in accordance with a key operation status signal from an operated key 33, and sets the cutter cam 84 or the cutter 41 on the basis of the sensing signal from the sensing switch 86.

Figure 7A:
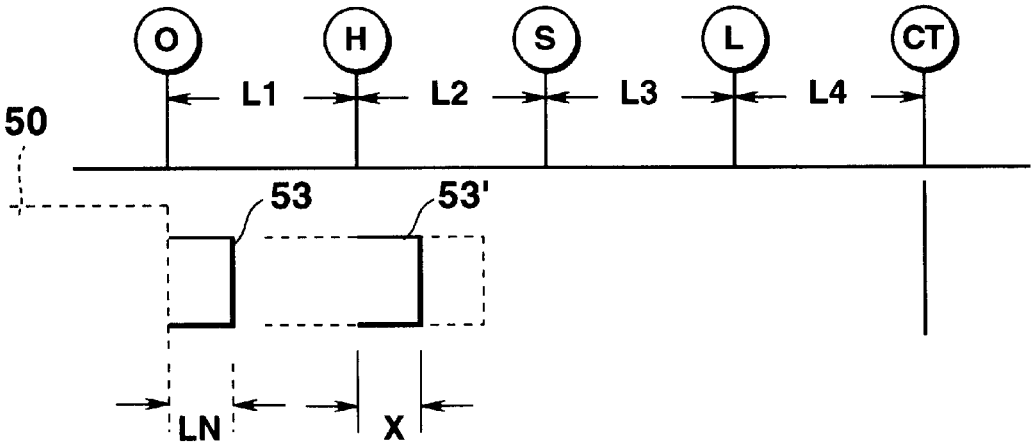
FIG. 7A diagrammatically shows the arrangement of the respective printer elements involved in the printing process performed by the printer of FIG. 1A.

The printing operation performed by the CPU 90 will be described next with reference to FIGS. 7A, 7B and 8. FIG. 7A diagrammatically shows the arrangement of the respective elements of the printer involved in the printing operation (see FIG. 1A). A reference character "0" shown in a small circle denotes a position of the feeding port 56 (FIGS. 1B and 2A) in the tape cassette 50. A reference character "H" shown in a small circle at a distance of L1 from the position "0" denotes a position of the thermal head 45. A reference character "S" shown in a small circle at a distance of L2 from the position "H" denotes a position of the ray cutting shutter 43. A reference character "L" shown in a small circle at a distance of L3 from the position "S" denotes a position of the fixing ray irradiator or the lamp 44. A reference character "CT" shown in a small circle at a distance of L4 from the position "L" denotes a position of the cutter 41. The indication of the tape sensor 42 is omitted.

Figure 7B:
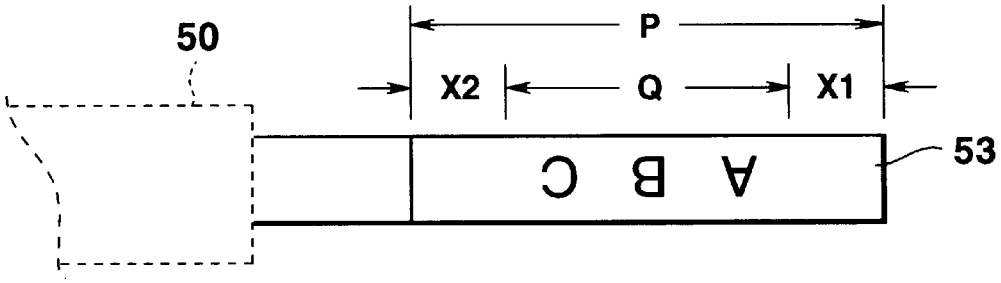
FIG. 7B shows a printed state of the printing tape.

FIG. 7B shows a printed state of the printing tape 53. A reference character "P" in FIG. 7B denotes the overall length of a printed tape portion on which the characters "ABC" are printed and cut away from the remaining tape. A reference character "Q" denotes a length of the printed area. Characters "X1" and "X2" respectively show a margin set at a leading and a trailing end of the printed area "Q" where the lengths of the margins X1 and X2 are equal to X.

Figure 8:
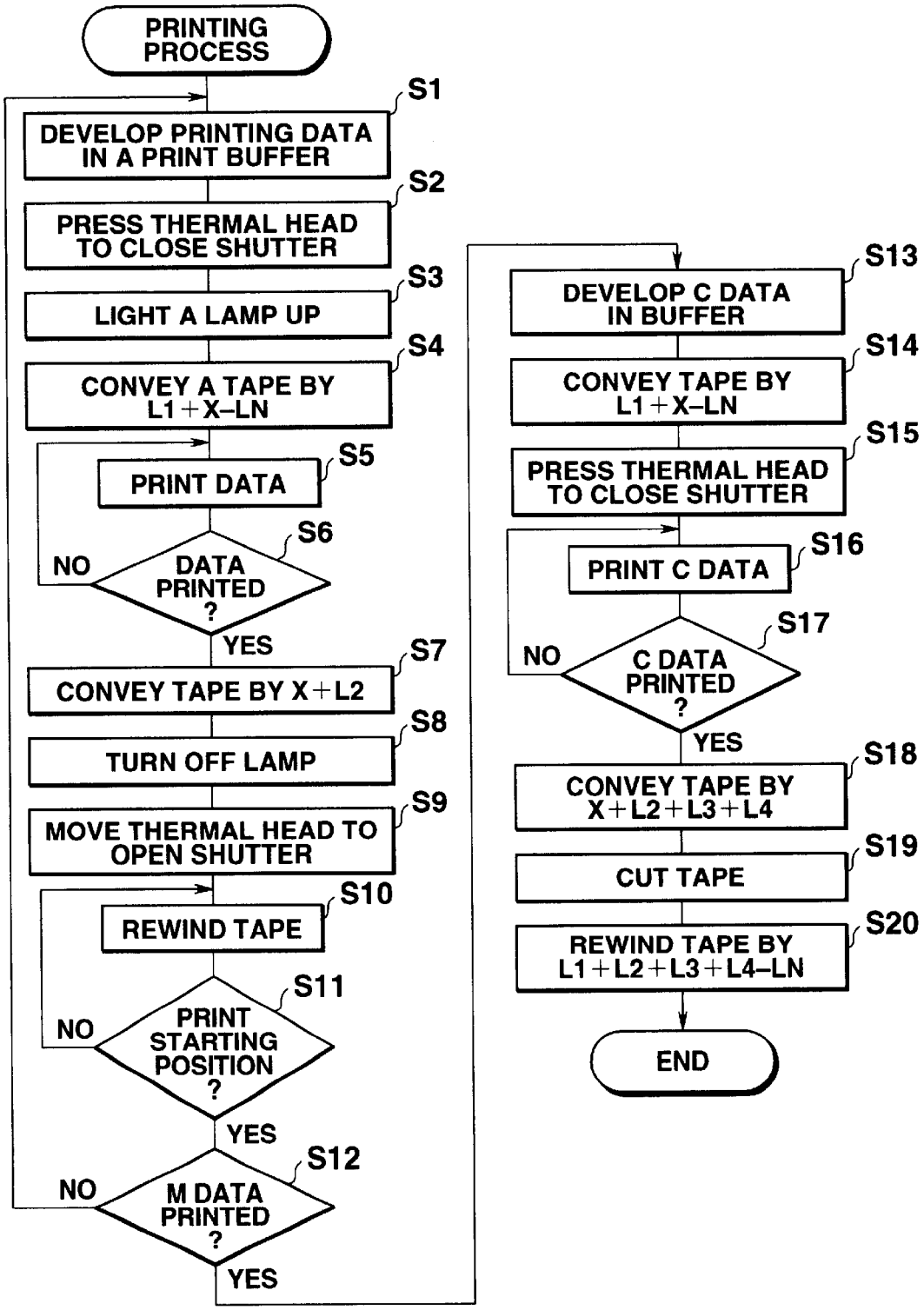
FIG. 8 is a flow chart of a printing operation performed by a CPU of the printer of FIG. 1A.

FIG. 8 is a flow chart of a printing process performed by the CPU 90 (fixing ray irradiation control means, conveyance control means). The CPU 90 first develops printing data (first, yellow printing data Y) in a predetermined area of the RAM 92 (step S1). Then, the CPU 90 delivers a drive command signal to the crutch driver 96 to turn the head turning member 65 counterclockwise by the cam (not shown) through the cam crutch to thereby press the thermal head 45 against the platen roller 39 and also close the shutter 43 (press the shutter 43 against the guide plate 40) (step S2, FIG. 4A). Thus, the thermal head 45 is set at the print starting position of the tape 53 and the thermal head 45 is cut from rays emitted from the lamp 44.

The CPU 90 then delivers a command signal to the lamp driver 93 to light up a lamp 44 (the yellow ray-fixing lamp 44*a* because initially, yellow printing is performed), (step S3). Thus, preparations for ray fixing of the printed data are ready.

Thereafter, the CPU 90 delivers a command signal to the driver 98 to cause the same to provide a drive signal of a predetermined frequency to the stepping motor 71 to thereby rotate the platen roller 39 forwardly (in the tape conveyance direction, or counterclockwise in FIG. 3A or 4A) and also rotate the reel drive shaft 36 forwardly to thereby convey the tape 53 by a distance of L1+X−LN (step S4).

As shown in FIG. 7A, the tape 53 of the cassette 50 set in the printer 30 is beforehand drawn up from the feeding port "0" by a length of LN. The CPU 90 recognizes this fact, using the tape sensor 42, and conveys the tape 53 by the distance of L1+X−LN. Thus, as shown by 53' in FIG. 7A, the end of the tape 53 initially drawn up by the length of LN from the feeding port "0" comes to a position advancing by the length of X (=X1) from the position "H" of the thermal head at a distance of L1 from the feeding port "0"or the leading printing position of the printing area "Q" with the margin of X1 of the tape 53 in FIG. 7B is set at the position "H" of the thermal head. In this case, if "LN<X" is preset, there is no problem because the tape portion of the length of LN falls within the range of the leading margin even if that tape portion loses its colorability by natural fixation caused by exposure with time due to the tape being drawn up by the length of LN from the feeding port "0".

After having conveyed the tape by the distance of L1+X−LN, the CPU further continues to convey the tape while sequentially providing the printing data developed in the RAM 92 in units of a line to the thermal driver 95 to cause the thermal head 45 to start printing the data (step S5).

The CPU 90 monitors this operation until the last line of the printing data is outputted or the printing of the developed printing data is completed (step S6). When the CPU 90 confirms the completion of the printing by receiving a detection signal from the tape sensor 42 (step S6), the CPU 90 conveys the tape 53 further by a distance of X+L2 on the basis of its confirmation of the completion of the printing (step S7).

Thus, a position on the tape 53 where the data printing has ended, or the trailing end of the printed area Q of the tape 53, stops at a distance of X (=X2) downstream from the shutter position "S" which is downstream by a distance of L2 from the position "H" of the thermal head, and the trailing end of the trailing margin of X2 is set at the shutter position "S". Thus, the tape portion having the length of P is then ray fixed.

More particularly, the leading margin "X1", printed area "Q" and the trailing margin "X2" of the yellow-colored printed tape portion of the overall length of P of FIG. 7B are sequentially irradiated with fixing rays and fixed. That is, further coloring of the printed tape portion with heat energy applied thereafter is inhibited. As described above, in the present embodiment, ray fixation is performed in the course where the tape 53 is conveyed forwardly for printing purposes.

Thereafter, the CPU 90 stops the stepping motor 71, hence the forward conveyance of the tape 53, and the lamp driver 93 to put off the lamp 44 (step S8). The CPU 90 then provides a command signal to the crutch driver 96 to turn the turning member 65 clockwise to move the thermal head 45 away from the platen roller 39 to open the ray cutting shutter 43 or move the shutter 43 from the guide plate 40 (step S9, FIG. 4B).

The CPU 90 then rotates the stepping motor 71 in a direction reverse to the tape conveying direction to rewind the tape 53 (step S10), and monitors the tape 53 until it is rewound to its initial position shown leftward in FIG. 7A (step S11). At this time, the CPU 90 determines whether the completed printing relates to magenta (step S12).

If the completed printing relates to yellow (S12), the CPU 90 returns its control to step S1, where it develops magenta printing data in the RAM 92 and then repeats the processing at the steps S2–S12 to perform magenta printing (coloring) and ray fixation, rewinds the tape 53 to its initial position, and again determines whether the completed printing relates to magenta.

Now, the determination at step S12 is affirmative, so that the CPU 90 develops cyan data in the RAM 92 (step S13). The subsequent processes at steps S14–S17 are identical to those at steps S4, S2, S5 and S6, respectively. In the last cyan coloring process, no fixation is performed because no more heat energy is applied to the printed tape portion, and hence no lamp is lighted up.

In this case, when the CPU 90 confirms the completion of the cyan printing (S17), the CPU 90 further conveys the tape 53 by a distance of X+L2+L3+L4 in the forward direction (step S18). Thus, the trailing end of the printed area "Q" of the tape 53 stops at a distance of X (=X2) downstream from the cutter position "CT" which is at a distance of L2+L3+L4 from the position "H" of the thermal head. That is, the trailing end of the trailing margin "X2" stops at the cutter position "CT".

Subsequently, the CPU 90 delivers a command signal to the DC motor driver 94 to drive the DC motor 76 to thereby drive the movable blade 41*a,* as shown in FIG. 5, to cut the printed tape portion 53 (step S19). Thus, as shown in FIG. 7B, the printed tape portion 53 of the length "P" with the leading and trailing margins "X1" and "X2" is cut away.

Thereafter, the CPU 90 moves the thermal head 45 away from the platen roller and rewinds the tape 53 by a distance of L1+L2+L3+L4−LN (step S20) to terminate this process. By rewinding the tape as mentioned above, an unused portion of the tape 53 from which the printed tape portion has been cut away is stopped at its leading end at a distance of LN downstream from the feeding port "0" which is at a distance of L1+L2+L3+L4 upstream from the cutter position "CT" where the printed tape portion was cut away, and waits for the next printing.

While in the above it was described that there was no problem even when the tape portion of the length "LN" fed out from the feeding port "0" loses its colorability due to the natural fixation, the tape may be conveyed so that a leading margin X1 is present after the tape portion of the length of "LN" in consideration of a possible color change in the naturally fixed tape portion due to being not used for a long time, and after printing, the leading end portion "LN" of the tape may be forcedly cut away. In that case, a timer which measures an unused time of the printer may be provided on the printer to automatically determine on the basis of the measured length of the unused time whether the leading end portion of the tape should be cut away. The conveyance distance of the tape for cutting purposes may be recognized with the number of drive pulses for the stepping motor or determined by an optical sensor which recognizes a cut mark printed at the trailing end of the tape portion "LN". In that case, the tape conveyance distance in the processing at step S4 is "L1+X" and it is not required to add "−LN". Similarly, the tape conveyance distance at step S14 is L1+X.

After the printed tape was cut away, the remaining tape may be rewound to the position of the feeding port "0", for example, by interlocking the opening/closing operation of the cover for the tape cassettes accommodating space 35 with the switching on/off operation of the drive power supply switch when the power supply is turned off after the printing (or when the printing is terminated and the printer is put away) or immediately before the cassette 50 is removed from the printer 30.

If the state of the tape 53' is present at all times when the cassette 50 is set in the printer 30, a preparation time required for the start of the printing is reduced. In this case, the processing at step S4 of FIG. 8 is not required, and the processing at step S11 includes confirming that the tape 53' is in the state of FIG. 7A.

When the cassette 30 is set in the printer 30, the tape 53 may be manually set at the printing position so that the tape 53' is in the state of FIG. 7A. This set position is sensed by the tape sensor 42 and referred to in the subsequent printing process. When the printing position is set in the automatic conveyance, the pair of conveyance rolls 58 in the cassette 50 is required to be driven on the side of the printer body.

Second Embodiment

Figure 9A:
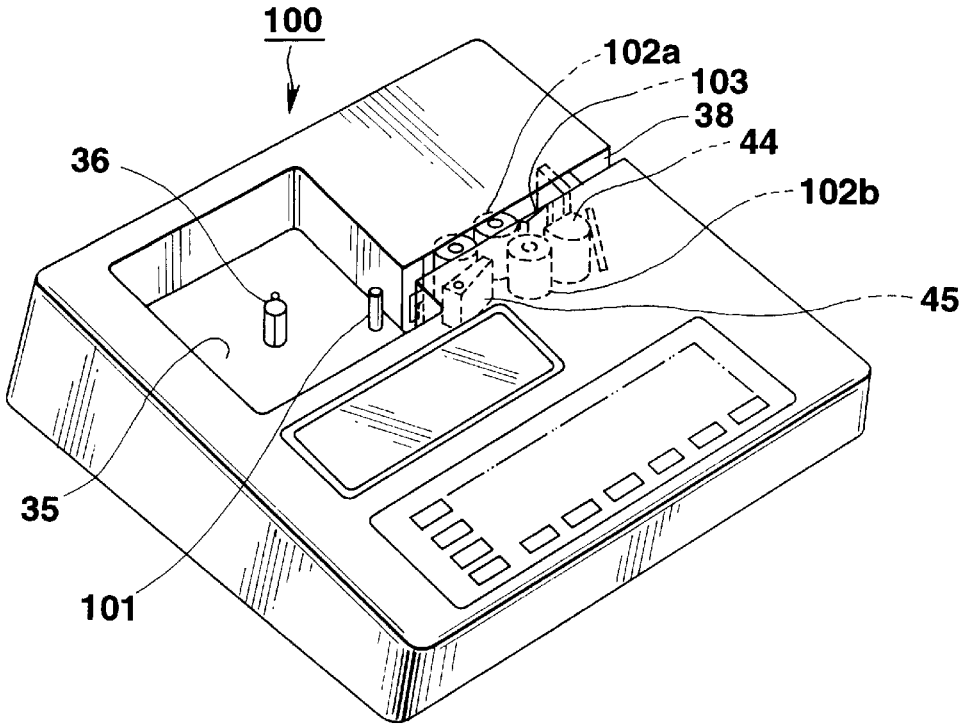
FIG. 9A is a simplified perspective view of a printer as a second embodiment of the present invention.
Figure 9B:
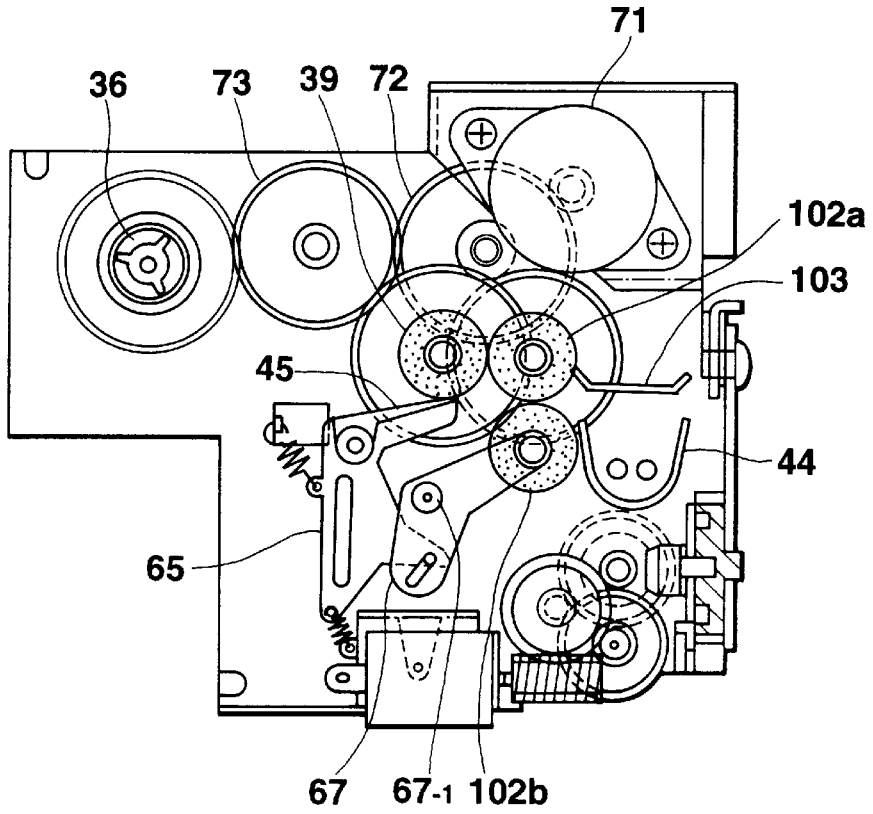
FIG. 9B shows a drive mechanism for the respective elements of the printer of FIG. 9A.

Alternatively, the ray cutting shutter may be composed of the pair of rolls to assist in the conveyance of the tape. This mechanism of a printer as a second embodiment will be described below. FIG. 9A is a simplified perspective view of a printer in the second embodiment. FIG. 9B shows the composition of its internal drive system. In the printer 100 of FIGS. 9A and 9B, a new reference numeral is used to denote an element different from those of the drive system of FIGS. 1A and 3A, and the same reference numeral is used to denote similar elements of the drive systems of FIGS. 1B, 2A, 2B and 9A, 9B and further description thereof will be omitted.

As shown in FIG. 9A, the printer 100 includes a pin 101 provided in the vicinity of a lower right-hand corner of the tape cassette accommodating space 35 to drive a pair of conveyance rolls. The pin 101 receives a torque from a drive system (not shown) branching appropriately from the chain of idle gears 72 and 73 and drives a pair of conveyance rolls (not shown) similar to the pair of conveyance rolls 58 of FIGS. 1B and 2A.

Thus, as shown in FIG. 7A, the tape 53 is conveyed (or fed out) forwardly to the position of the tape 53'. When the series of printing steps has been completed, the rewinding conveyance of the tape which automatically rewinds to whithin the cassette 50 the unused tape portion extended from the cutter position "CT" to the position of the feeding port "0" with an leading end portion "LN" left is performed by the reel drive shaft 36 with the aid of the pair of conveyance rolls, as described above with respect to the processing at step S20.

A pair of auxiliary rolls 102*a* and 102*b* is disposed between which the conveyance path 38 extends instead of the ray cutting shutter 43 of FIG. 1A provided between the lamp (fixing ray irradiator) 44 and the thermal head 45. In this case, one roll 102*a* of the pair is positioned on the other side of the conveyance path 38, so that a space in which a guide plate 103 is disposed is reduced correspondingly. Thus, the guide plate is formed shorter than the guide plate 40 of FIGS. 1A and 3A.

As shown in FIG. 9B, the auxiliary roll 102*a* is pivoted on the printer body between the platen roller 39 and the guide plate 103. The other auxiliary roll 102*b* is provided rotatably to a right-hand arm end of the shutter turning arm 67 engaged with the head turning member 65 integral with the thermal head 45, so that it moves clockwise or counterclockwise in conjunction with the clockwise or counterclockwise movement of the thermal head 45 like the shutter 43 of FIGS. 4A and 4B. When the thermal head 45 turns counterclockwise around the pivot to press against the platen roller 39 to take a printing attitude, the roll 102*b* moves counterclockwise around the pivot to press against the other fixed roll 102*a*.

The pair of auxiliary rolls 102*a* and 102*b* is composed of a soft material such as sponge or felt. As described above, when two rolls 102*a* and 102*b* press against each other, an unused portion of the tape 53 present on the left side of the rolls 102*a* and 102*b* is cut from rays emitted from the lamp 44.

When the thermal head 45 moves clockwise from the platen roller 39 to open the conveyance path, the roll 102*b* also moves clockwise around the pivot 67 away from the other roll 102*a* to open the conveyance path similarly. Also, in this composition, the printing operation is performed in a similar manner to that performed in FIGS. 7A, 7B and 8.

Third Embodiment

Figure 10A:
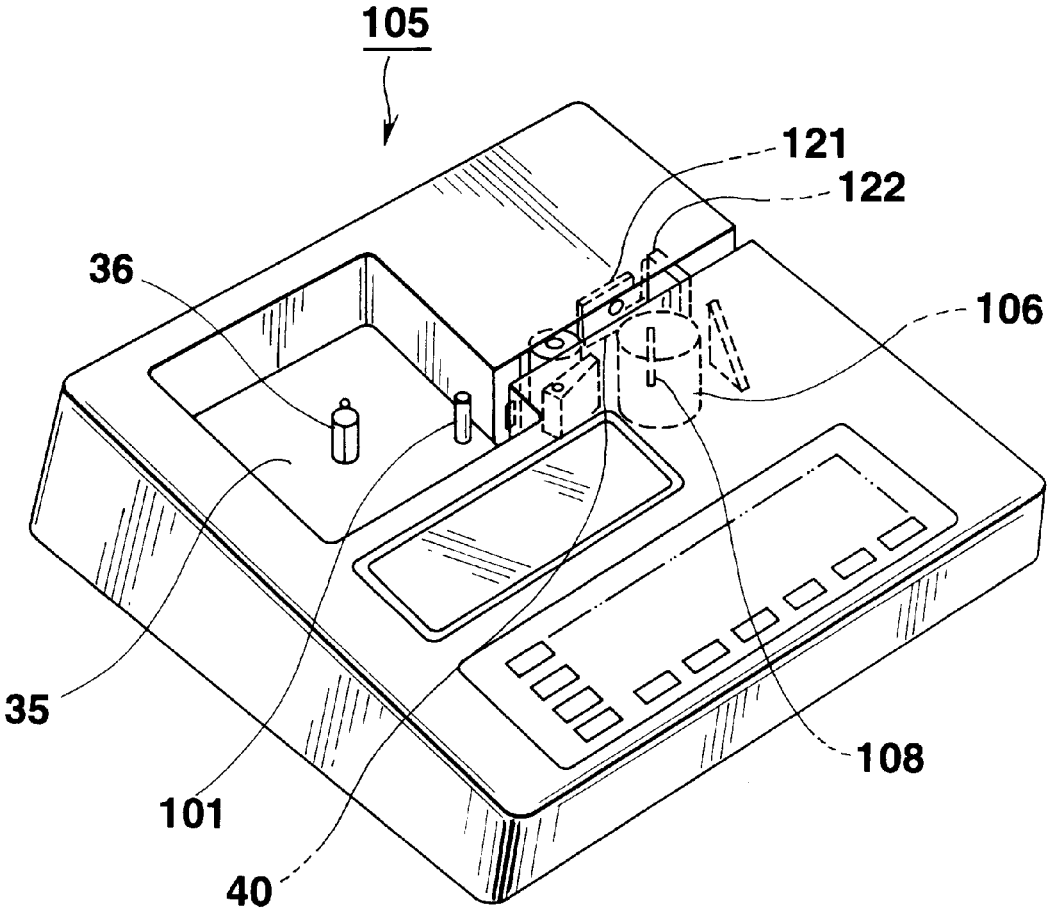
FIG. 10A is a simplified perspective view of a printer as a third embodiment of the present invention.
Figure 10B:
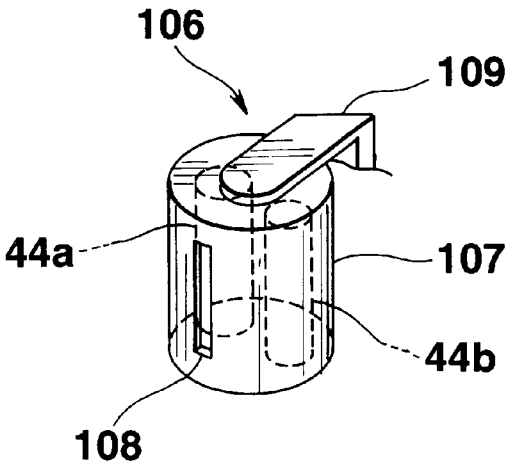
FIG. 10B is a perspective view of a fixing ray irradiator provided in the printer of FIG. 10A.

FIG. 10A is a simplifed perspective view of a printer as a third embodiment of the present embodiment. FIG. 10B shows a lamp (fixing ray irradiator) disposed in this printer. Also, in this case, a new reference numeral is used to denote a different element from any one of those of the printer 30 of FIG. 1A, and the other remaining elements of the printer as well as the cassette are similar to those of FIG. 1A. Thus, the same reference numeral is used to denote similar elements in FIG. 1A and 10A. A lamp unit 106 provided in a printer 105 of FIG. 10A instead of the lamp 44 of the printer 30 of FIG. 1A includes a yellow and a magenta ray-fixing lamp 44*a* and 44*b* accommodated within a hollow cylindrical ray cutting case 107, as shown in FIG. 10B.

The case 107 is provided thereon with a slit 108 formed at a position facing the guide plate 40, as shown in FIG. 10A. While the lamp 44 of FIG. 1A has an open case, as shown in FIGS. 3A, 4A and 4B, the lamp 106 of FIGS. 10A and 10B cuts irradiation rays from the internal yellow or magenta ray-fixing lamp 44*a* or 44*b* with the hollow cylindrical case 107 so that the irradiation rays are allowed to pass through the slit 108 only in a predetermined direction (perpendicular to a surface of the guide plate 40). The case 107 is supported by a bracket 109 which is fixed to a frame (not shown) of the printer.

The guide plate 40 is pressed at all times against the slit 108 of the lamp 106 by a coil spring 122 provided between a frame 121 of the printer body and the guide plate 40. In this case, by regarding the lamp and shutter positions L and S as the same in FIG. 7A, or by regarding the distance "L3" as 0, the processing in FIG. 8 is required to be performed.

In any one of the above embodiments, the cutter 41 is not required to be automatically driven by the DC motor 76, but may be manually driven, for example, by a push button or an operation lever integral with the movable blade to cut the printed tape away. While in the above embodiments, ray fixation is illustrated as being performed in the course where the tape 53 is conveyed forwardly for printing purposes, it may be performed in the tape returning or rewinding operation, which will be described next.

Fourth Embodiment

Figure 11A:
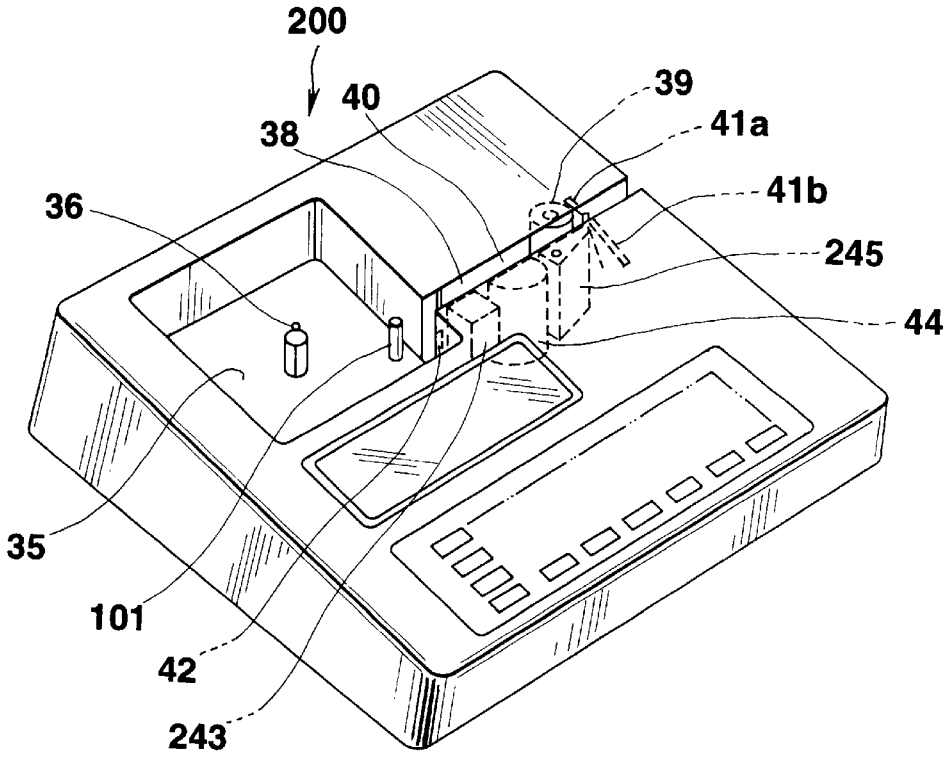
FIG. 11A is a simplified perspective view of a printer as a fourth embodiment of the present invention.
Figure 11B:
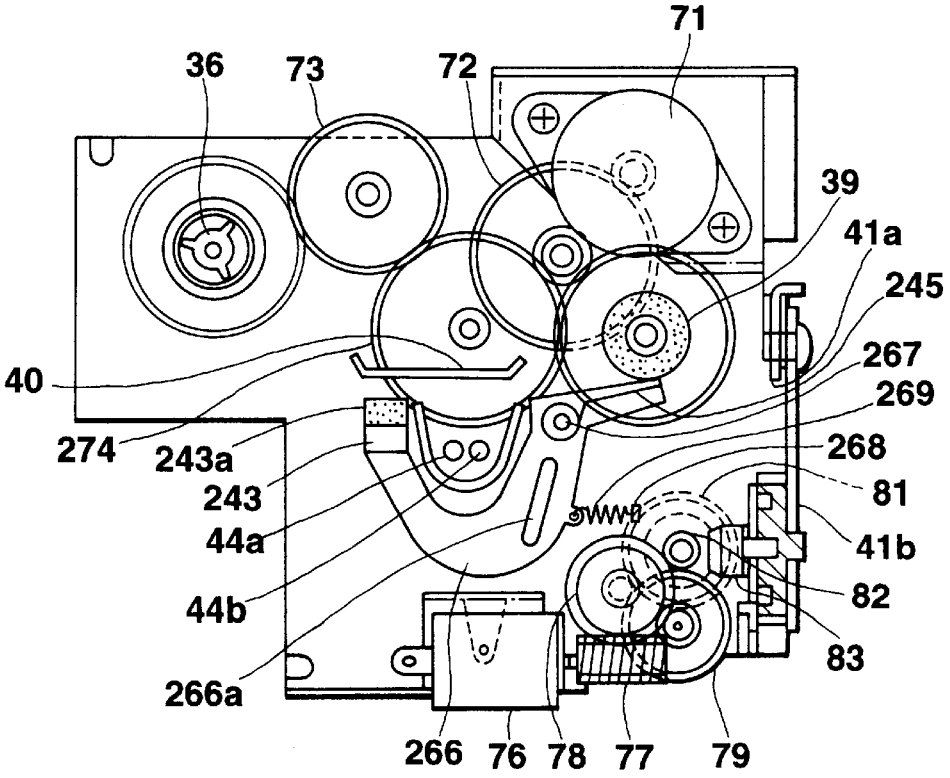
FIG. 11B shows a drive mechanism for the respective elements of the printer of FIG. 11A.
Figure 12B:
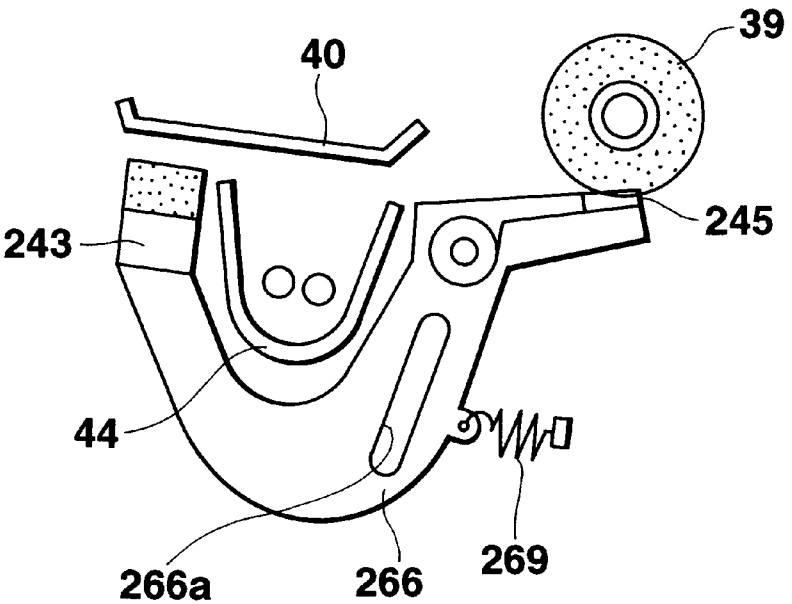
FIGS. 12A and 12B illustrate operation of a thermal head and a ray cutting shutter driven in interlocking relationship by the drive mechanism of FIG. 11B.
Figure 12A:
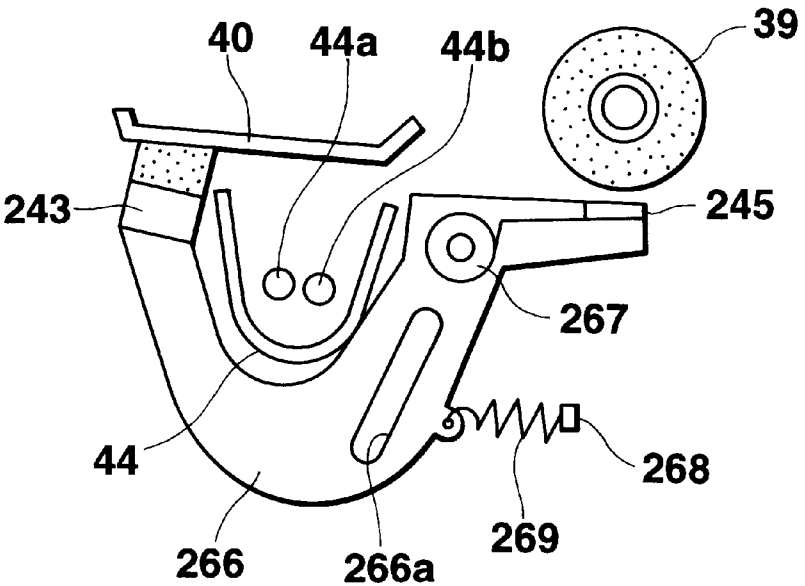

FIG. 11A is a simplified perspective view of a printer as a forth embodiment. FIG. 11B shows the composition of its internal drive system. A new reference numeral is used to denote an element of the printer 200 of FIGS. 11A and 11B different from any one of the elements of the printer 100 of FIGS. 9A and 9B, and the same reference numeral is used to denote similar elements of FIGS. 11A, 11B, 9A and 9B. FIGS. 12A and 12B each show a thermal head 245 and a ray cutting shutter 243 driven in interlocking relationship by the drive mechanism.

As shown in FIG. 11A, a guide plate 40, a platen roller 39, and a fixed blade 41*a* of a cutter 41 are disposed in this order from the upstream side of the tape conveyance path 38 to its downstream side on the other side of the conveyance path 38. A tape sensor 42 (tape sensing means), a ray cutting shutter 243 (ray cutting means), a fixing ray irradiator 44 (fixing ray irradiating means), a thermal head 245, and a movable blade 41*b* of the cutter 41 are disposed in this order from the upstream side of the conveyance path 38 to its downstream side on this side of the conveyance path 38.

As shown in FIG. 11B, the thermal head 245 is integral with a U-like arm 266 (supporting means) and supported rotatably at a pivot 267 in the junction of the thermal head 245 and the U-like arm 266. A fixing ray irradiator 44 comprising a yellow and a magenta ray-fixing lamp 44*a* and 44*b* is disposed within the space formed by the U-like arm 266. The U-like arm 266 has a ray cutting shutter 243 attached to the other end thereof. The ray-cutting shutter 243 has thereon a soft material 243*a* such as sponge or felt of a ray cutting property. A branch portion of the U-like arm 266 which supports the thermal head 245 has a slot 266*a* in which a cam pin (not shown) is slidably received. A coil spring 269 is provided which extends between the branch portion having the slot 266*a* and a fixed frame 268. When the cam pin (not shown) moves upward in the slot 266*a* in the arm branch portion of FIG. 11B, the U-like arm 266 turns clockwise around the pivot 267 against the resiliency of the coil spring 269 to move the thermal head 245 away from the platen roller 39 and press the ray cutting shutter 243 against the guide plate 40. When the cam pin then moves downward in the slot 266*a* from that state, the U-like arm 266 is turned counterclockwise around the pivot 267 by the resiliency of the coil spring 269, as shown in FIG. 12B, to press the thermal head 245 against the platen roller 39 and move the ray cutting shutter 243 away from the guide plate 40.

As described above, by the interlocking mechanism which includes the U-like arm 266, slot 266*a,* cam pin (not shown), pivot 267 and coil spring 269, the ray cutting shutter 243 is moved depending on the pressing/moving of the thermal head 245 against/away from the platen roller 39. The ray cutting shutter 243 presses against the guide plate 40 to limit to within a predetermined range the irradiation area of the fixing rays emitting by the yellow and magenta ray-fixing lamps 44*a* and 44*b* of the fixing ray irradiator 44.

As shown in FIG. 11B, in the present embodiment, the platen roller 39 is driven by the motor 71 through the idle gear 72, and the reel drive shaft 36 is driven by the motor 71 through the idle gears 72, 274 and 73.

Figure 13:
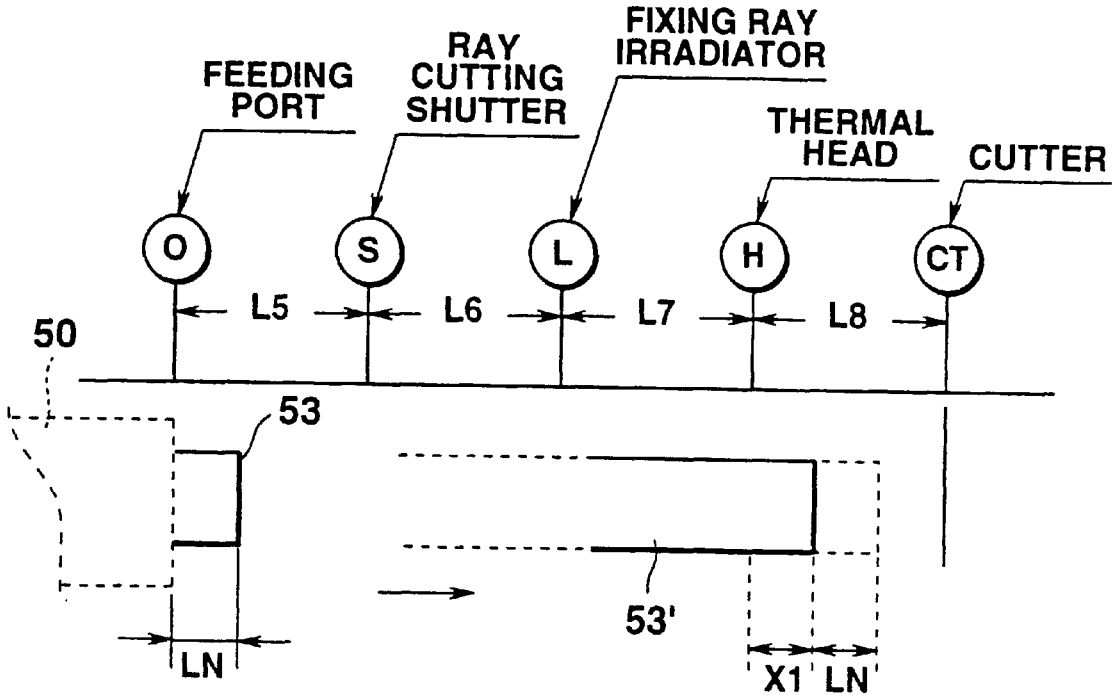
FIG. 13 diagrammatically shows the arrangement of the respective printer elements involved in the printing process performed by the printer of FIG. 11A.
Figure 14:
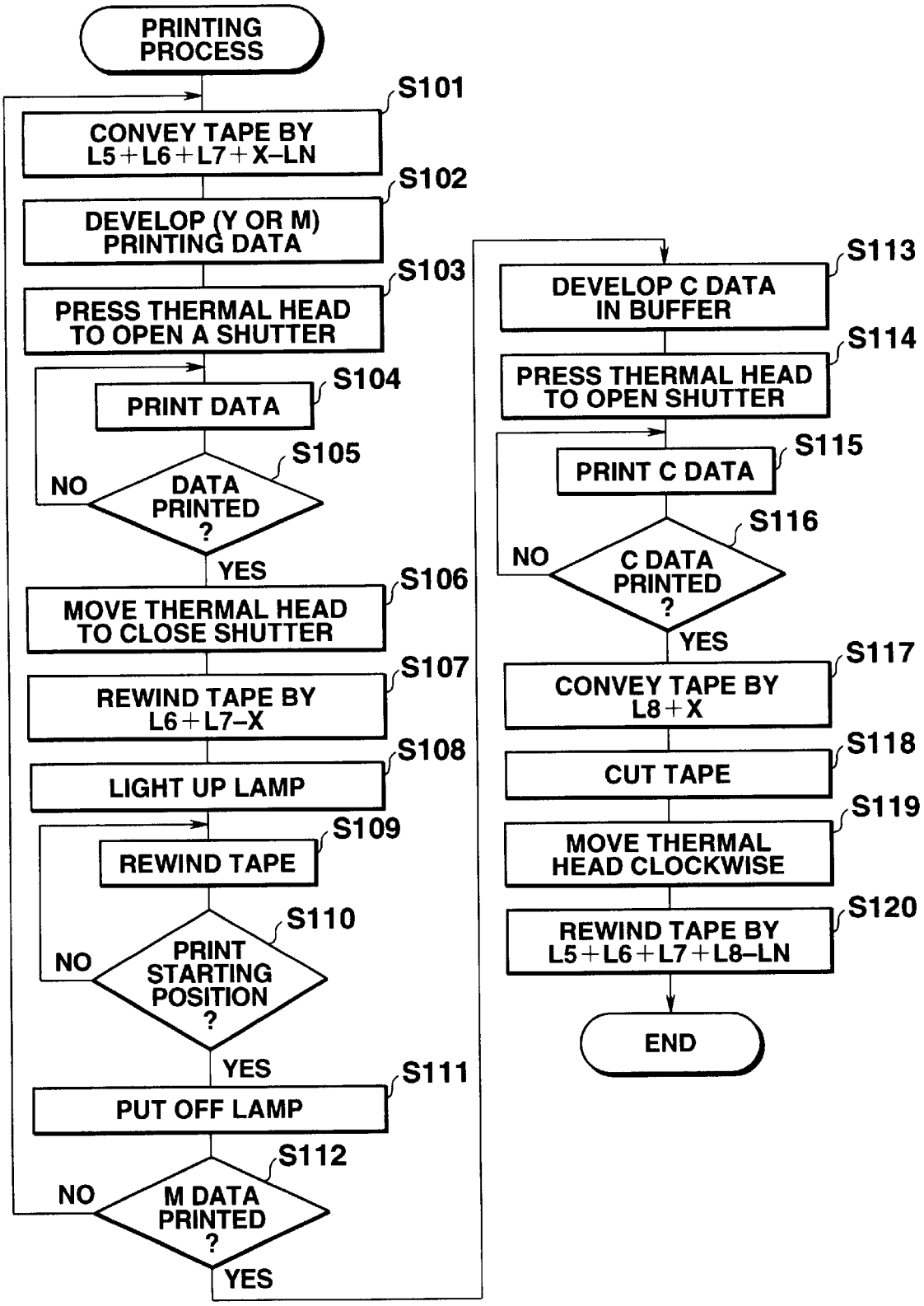
FIG. 14 is a flow chart of a printing operation performed by the printer FIG. 11A.

FIG. 13 diagrammatically illustrates the arrangement of the elements of the present printer involved in the printing process in a manner similar to that described with reference to FIG. 7A. FIG. 14 is a flow chart of the printing process performed by the CPU 90 (fixing ray irradiation controlling means, conveyance controlling means).

As shown in FIG. 13, the tape 53 of the cassette 50 set in the printer 200 is beforehand pulled out by a length of LN from the feeding port "0". The CPU 90 recognizes this fact with the aid of the tape sensor 42. First, the CPU 90 conveys the tape 53 by a distance of L5+L6+L7+X−LN (step S101). Thus, the leading end of the tape 53 pulled out by the length of LN from the feeding port "0" initially stops at a length of X (=X1) downstream from the position "H" of the thermal head which is at a distance of L5+L6+L7 from the feeding port "0", as shown by a tape 53' of FIG. 13. The leading printing position of the printing area "Q" with a leading margin "X1" of the tape 53 is set at the position "H" of the thermal head. In this case, if the position of the tape is preset so as to satisfy the condition "LN<X", there is no problem because the portion "LN" of the tape pulled out from the feeding port "0" falls in the range of the leading margin of the tape even if the tape portion of "LN" loses its colorability due to natural fixation caused by its exposure with time because that portion is pulled out from the feeding port "0".

Thereafter, the CPU 90 develops printing data (initially, yellow printing data) in a predetermined area of the RAM 92 (step S102). Then, the CPU 90 delivers a drive command signal to the crutch driver 96 to turn the U-like arm 266 counterclockwise to press the thermal head 245 against the platen roller 39 and open the shutter 243 or move the shutter 243 away from the guide plate 40 (step S103, FIG. 12B). Thus, the thermal head 245 is set at the position where the tape 53 starts to be printed.

The CPU 90 then delivers a command signal to the driver 98 to cause the same to deliver a drive signal of a predetermined frequency to the stepping motor 71 to thereby rotate the platen roller 39 forwardly (in the tape conveying direction or counterclockwise in FIG. 11B). Simultaneously, the CPU 90 delivers the developed printing data in units of a line to the thermal head driver 90 to cause the thermal head 245 to start printing (step S104). At this time, the CPU monitors the delivery of the developed printing data until the printing data for the last line is output or printing of the developed printing data is completed (step S105). When the CPU 90 confirms that the printing has been completed (step 105), it delivers a command signal to the crutch driver 96 to cause the U-like arm 266 to turn clockwise to move the thermal head away from the platen roller 39 to close the shutter 243 (or press the shutter 243 against the guide plate 40) (step S106, FIG. 12A).

Thereafter, the CPU 90 rotates the stepping motor 71 reversely to rotate the reel drive shift 36 in a winding direction to thereby rewind the tape 53 by a distance of L6+L7−X (step S107). Thus, the trailing end of the printing area Q of the tape 53 where the printing ends stops at a distance of "X" (=X2) downstream from the shutter position "S", which is at a distance of L6+L7 upstream from the position "H" of the thermal head or the trailing end of the trailing margin of X2 is set at the shutter position "S".

The CPU 90 then outputs a command signal to the lamp driver 93 to light up a fixing lamp 44 (yellow ray-fixing lamp 44*a*) (step S108) and to rewind the tape 53 again (step S109). Thus, the trailing margin "X2", printing area and leading margin "X" are sequentially irradiated with (or exposed to) the fixing rays, and yellow coloring of those areas are inhibited by heat energy applied to the areas thereafter and fixed. As described above, the ray fixation is performed in the course where the tape 53 is rewound.

During the fixation, the CPU 90 monitors a sensing signal received from the tape sensor 42 (step S110). The CPU then confirms that the tape has been rewound by a total distance of L7+L8+L5−LN from the initial winding position or that the tape has been rewound to the initial position of the tape 53 shown leftward in FIG. 13 (S110). The CPU then stops the stepping motor 71, puts off the lamp 44 (step S111), and then determines whether the just completed printing relates to magenta (step S112).

If the just completed printing relates to yellow (S112), the CPU 90 returns its control to step S101, where it conveys the tape 53 to the position of the tape 53', develops magenta printing data in the RAM 92 at step S102, and then repeats the processing at steps S103–S112. Thus, the CPU performs the printing (coloring) of the magenta and ray fixation, rewinds the tape 53 to its initial position, and then again determines whether the just completed printing relates to magenta.

Now, determination at step S112 is affirmative. In this case, the CPU 90 develops cyan data in the RAM 92 (step S113). The processing at subsequent steps S114–116 is the same as that at steps S103–105. When the CPU confirms the completion of cyan printing (S116), it conveys the tape 53 by a distance of L8+X further forwardly (step S117). Thus, the trailing end of the printing area "Q" of the tape 53 stops at a distance of X (=X2) downstream from the cutter position "CT", which is at the distance of L8 from the position "H" of the thermal head. That is, the trailing end of the trailing margin of X2 stops at the cutter position "CT".

Thereafter, the CPU 90 delivers a command signal to the DC motor driver 94 to cause the DC motor 76 to rotate to thereby drive the movable blade 41*a,* as shown in FIG. 5 (step S118), to cut away the printed tape portion 53 of a length of P with the leading and trailing margins of X1 and X2, as shown in FIG. 7B.

Thereafter, the CPU 90 moves the thermal head 245 clockwise (step S119), rewinds the tape 53 by a distance of L5+L6+L7+L8−LN (step S120), and then terminates this processing. An end of an unused portion of the tape 53 from which the printed tape portion was cut away stops at a distance of LN downstream from the feeding port "0" which is at a distance of L5+L6+L7+L8 upstream from the cutter position "CT" for waiting for the next printing.

Fifth Embodiment

Figure 15:
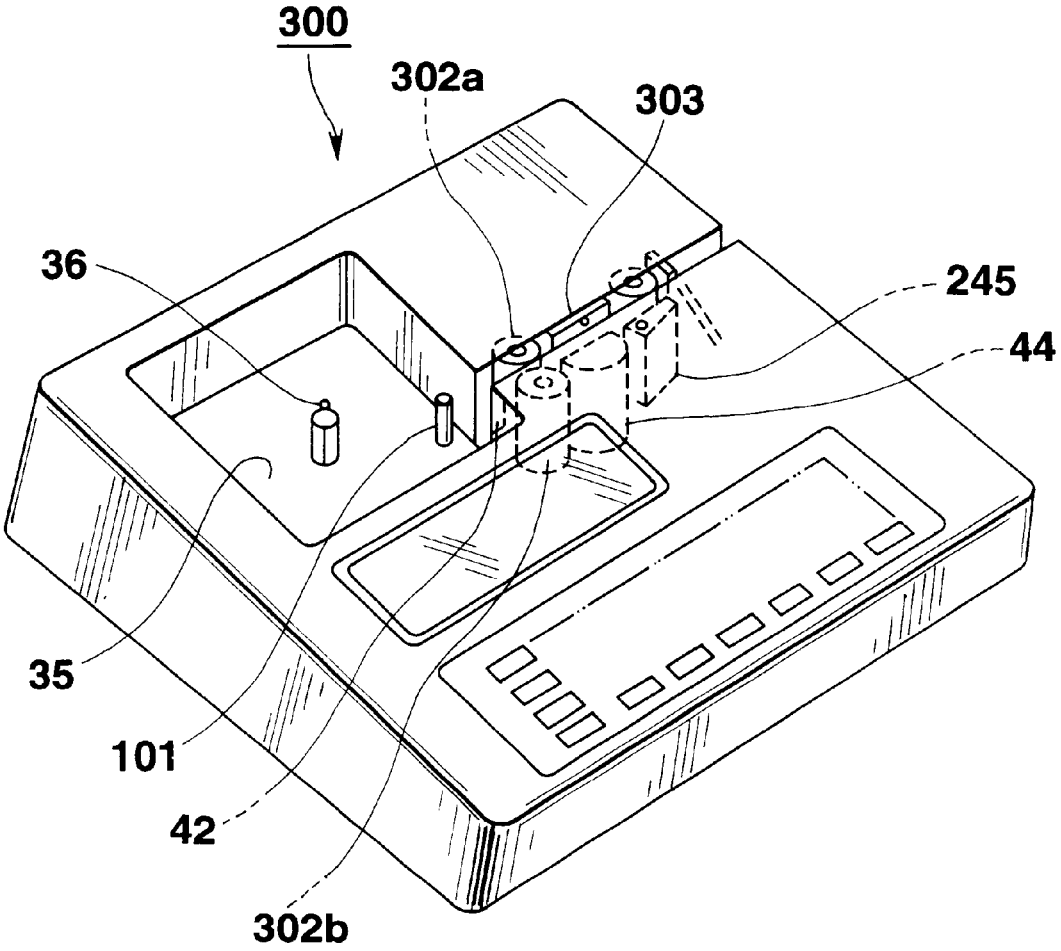
FIG. 15 is a perspective view of a printer according to a fifth embodiment of the present invention.

FIG. 15 is a simplifed perspective view of a printer as a fifth embodiment. The printer 300 of FIG. 15 is partially different in composition from the printer 200 of FIG. 11. A new reference numeral is used to denote a different element from any one of those of the printer 200 of FIG. 11A, and the same reference numeral is used to denote similar elements of the printers of FIGS. 15 and 11A.

The printer 300 of FIG. 15 includes a pair of auxiliary rolls 302*a* and 302*b* each provided on a respective one of sides of the tape conveyance path 38 instead of the shutter 243 of FIG. 11A provided between the tape sensor 42 and the lamp (fixing ray irradiator) 44. A space in which the guide plate 303 is disposed is reduced by a space which one auxiliary roll 302*a* of the pair is positioned on the other side of the conveyance path 38, and hence the guide plate 303 is formed shorter than the guide plate 40 of FIG. 11A.

Figure 16B:
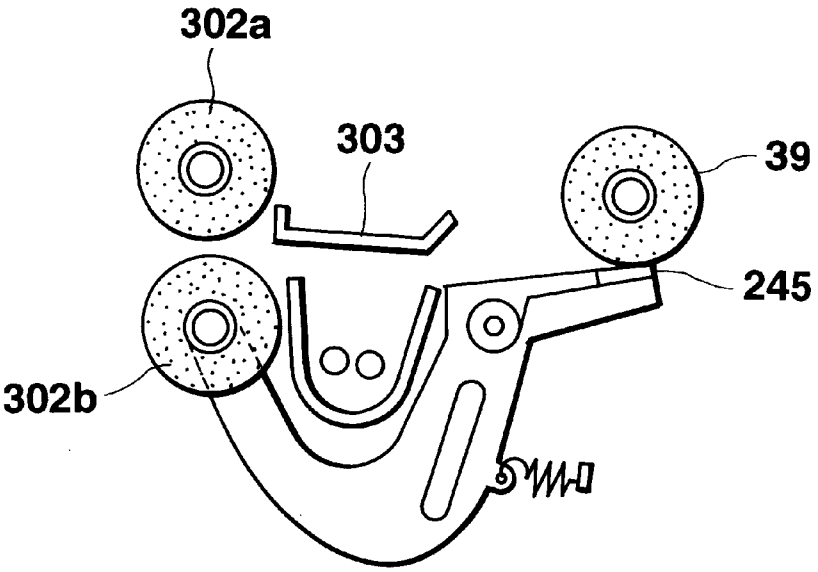
FIGS. 16A and 16B illustrate operation of a thermal head and a ray cutting shutter driven in interlocking relationship by the drive mechanism of FIG. 15.
Figure 16A:
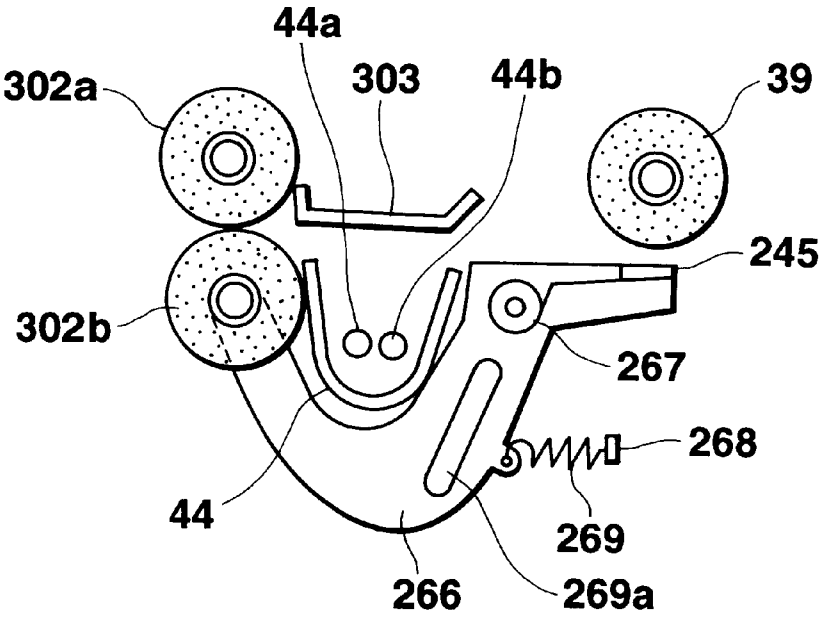

FIGS. 16A and 16B each show the operation of the thermal head 245 and the pair of auxiliary rolls 302*a* and 302*b*. As shown in FIG. 16A, the other auxiliary roll 302*b* of the pair is provided rotatably to an end of the U-like arm 266 integral with the thermal head 245. The pair of auxiliary rolls 302*a* and 302*b* is made of a soft material such as sponge or felt. When the U-like arm 266 turns clockwise around the pivot 267 as shown in FIG. 16A to move the thermal head 245 away from the platen roller 39. Simultaneously, the two rolls 302*a* and 302*b* of the pair press against each other to shield a left-hand side of the pair of rolls 302*a* and 302*b* or an unused portion of the tape 53 from the irradiation rays of the lamp 44.

When the U-like arm 266 turns around the pivot 267 counterclockwise as shown in FIG. 16B so that the thermal head 245 presses against the platen roller 39 to thereby start to take a printing attitude, the two auxiliary rolls 302*a* and 302*b* move away from each other to open the tape conveyance path. Also, in this composition, the printing process is similar to that illustrated in FIGS. 13 and 14.

Sixth Embodiment

Figure 17:
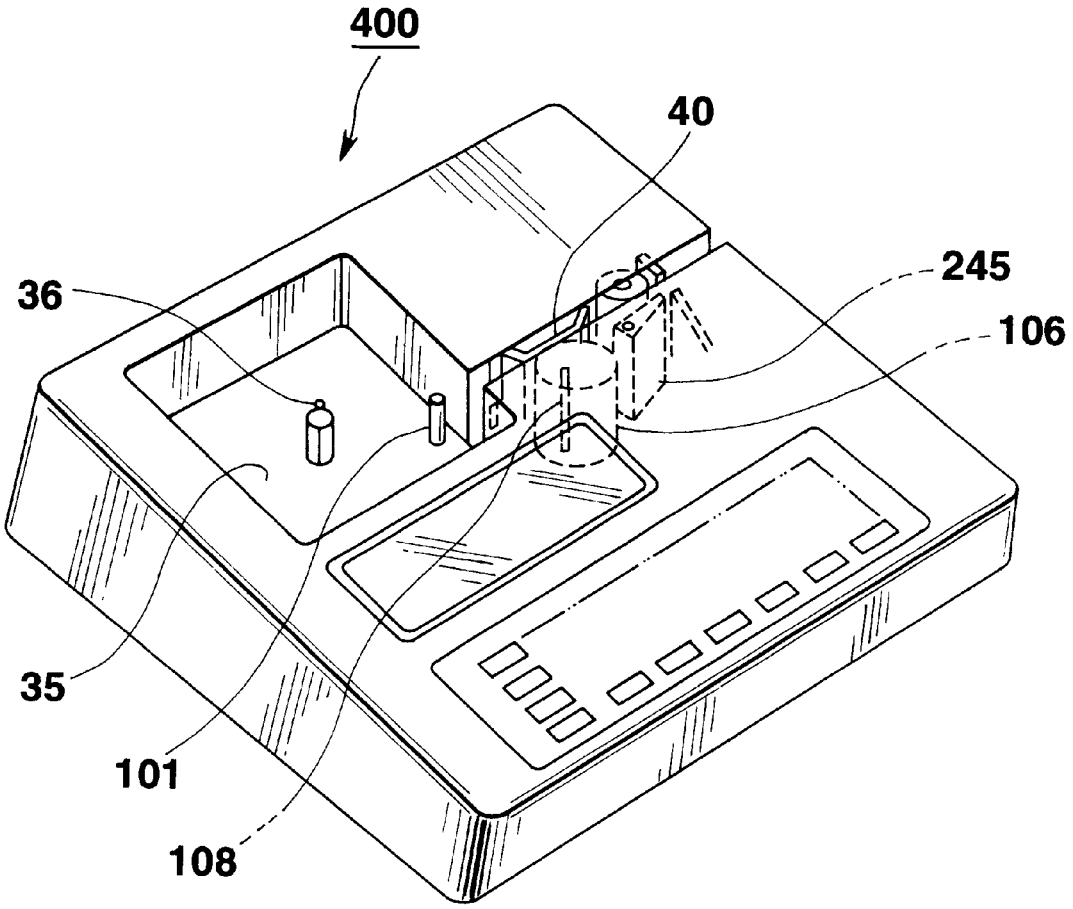
FIG. 17 is a simplified perspective view of a printer as a sixth embodiment of the present invention.

FIG. 17 is a simplified perspective view of a printer as a sixth embodiment in which the lamp 44 of the printer 200 of FIG. 11A is replaced with the lamp 106 of FIG. 10B. In the present embodiment, a bracket 109 of the lamp 106 (FIG. 10B) has a turning arm (not shown) which is connected to the thermal head 245. Thus, when the thermal head 245 turns to the printing position, the lamp 106 moves away from the guide plate 40. When the thermal head turns to a non-printing position, the lamp 106 turns toward the guide plate 40 and a slit 108 in the lamp 106 is brought into close contact with the tape 53 which is guided by the guide plate 40 and rewound for fixing purposes to thereby irradiate only the tape surface with the fixing rays.

In this printing process, by regarding the lamp and shutter positions "L" and "S" as the same or the distance of L6 as 0 in FIG. 13, the same process as in FIG. 14 is required to be performed.

While in the forth, fifth and sixth embodiments the ray cutting shutter and lamp are disposed upstream of the thermal head in the tape conveyance direction, the present invention is not limited to those particular cases. For example, the ray cutting shutter and lamp may be disposed downstream of the thermal head in the tape conveyance direction, which will be described next as a seventh embodiment.

Seventh Embodiment

Figure 18A:
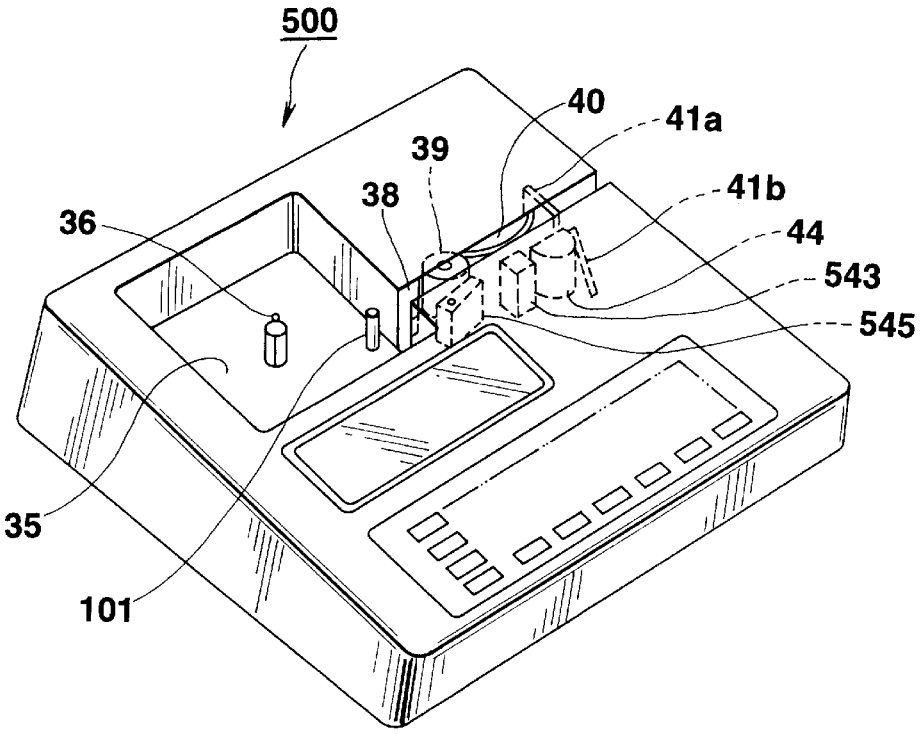
FIG. 18A is a simplified perspective view of a printer as a seventh embodiment of the present invention.
Figure 18B:
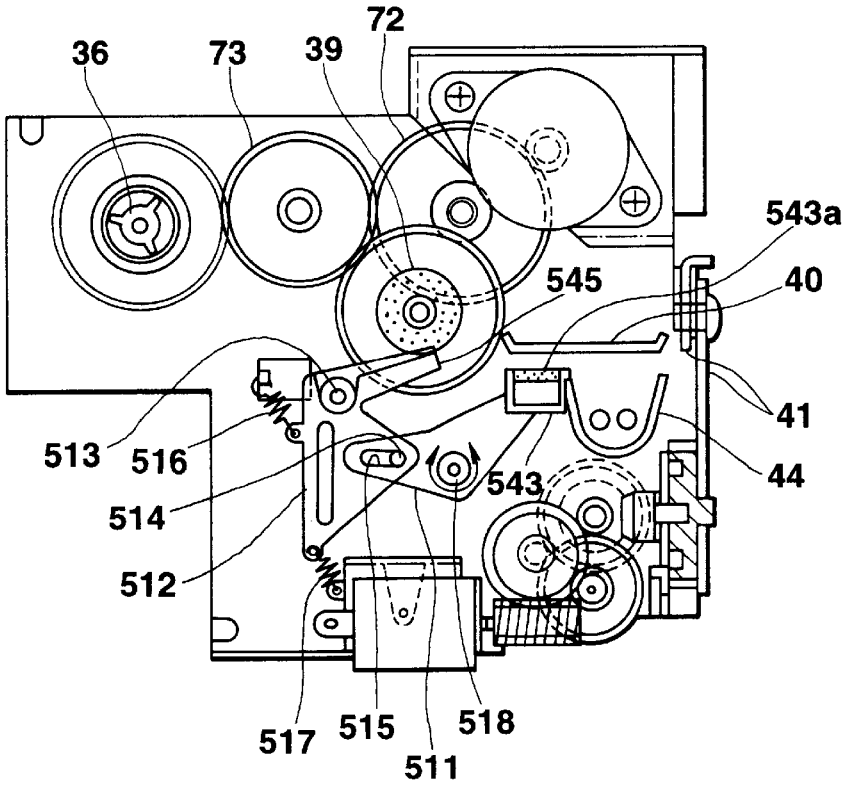
FIG. 18B shows a drive mechanism for the respective elements of the printer of FIG. 18A.

FIG. 18A is a simplifed perspective view of a printer of the seventh embodiment, and FIG. 18B shows the composition of an internal driving system of the printer. In the printer 500 of FIGS. 18A and 18B, a platen roller 39, a guide plate 40, a thermal head 545, a ray cutting shutter 543 and a lamp 44 are different in arrangement from the corresponding ones of FIG. 11A. Furthermore, the mechanism of FIG. 18B is different from that of FIG. 11B in that U-like arm 266 of FIG. 11B is divided into a turning arm 511 which supports the ray cutting shutter 543 and a second turning member 512 which is engaged with the turning arm 511 to support the thermal head 545. As in FIG. 3A, the platen roller 39 is driven along with a reel drive shift 36 by a motor 71 through idle gears 72, 73, etc. It is to be noted that the functions of the respective mechanism elements are substantially the same as corresponding ones of FIGS. 11A and 11B. The controller which controls the respective elements of the printer is similar in composition to that of FIG. 6.

As shown in FIG. 18A, in the printer 500, the platen roller 39, guide plate 40 and cutter's fixed blade 41*a* are disposed in this order from the upstream side of the conveyance path 38 to its downstream side on the other side of the conveyance path 38. On this side of the conveyance path 38, the thermal head 545, ray cutting shutter 543, lamp 44 and cutter's movable blade 41*b* are disposed in this order from the upstream side of the conveyance path 38 to its downstream side in opposite relationship to the platen roller 39, guide plate 40 and cutter's fixed blade 41*a*.

The turning arm 511 is supported rotatably by a pivot 518 at a midpoint thereof. The turning arm 511 supports the shutter 543 at a right-hand portion thereof, has a slot 515 in its left-hand portion extending along its axis and is engaged with a drive system (not shown) so as to be driven clockwise or counterclockwise.

The second turning member 512 supports the thermal head 545 at its upper end and turnably supported at a pivot 513. The turning member 512 has a pin 514 provided in a right-hand vertex of a triangular body thereof and received slidably within the slot 515 in the turning arm 511. The second turning member 512 is biased clockwise around the pivot 513 by a coil spring 516 provided between the frame of the printer body and a point on an edge of the turning member 512 between the pivot 513 and the lower end of the turning member 512. The turning member 512 is also biased counterclockwise around the pivot 513 by a coil spring 517 extending between another frame of the printer body and the lower end of the second turning member.

In this arrangement, the turning arm 511 is turned clockwise around the pivot 518 so that as shown in FIG. 18B, an end 543*a* of the ray cutting shutter 543 provided at the end of the right-hand portion of the truning arm 511 moves away from the guide plate 40 to abut on the right-hand adjacent lamp 44 to stop to thereby open the conveyance path 38. Simultaneously, the left-hand portion of the turning arm 511 is turned clockwise. Thus, the second turning member 512 turns counterclockwise through the slot 515 and pin 514 connection. Thus, the thermal head 545 presses against the platen roller 39 to be placed at the printing position.

When the turning arm 511 is turned counterclockwise, the end 543*a* of the shutter 543 abuts on the guide plate 40 to cut diffusion of fixing rays emitted by the lamp 44 toward the upstream side of the conveyance path. Simultaneously, the thermal head 545 moves away from the platen roller 39 to open the conveyance path 38.

Figure 19:
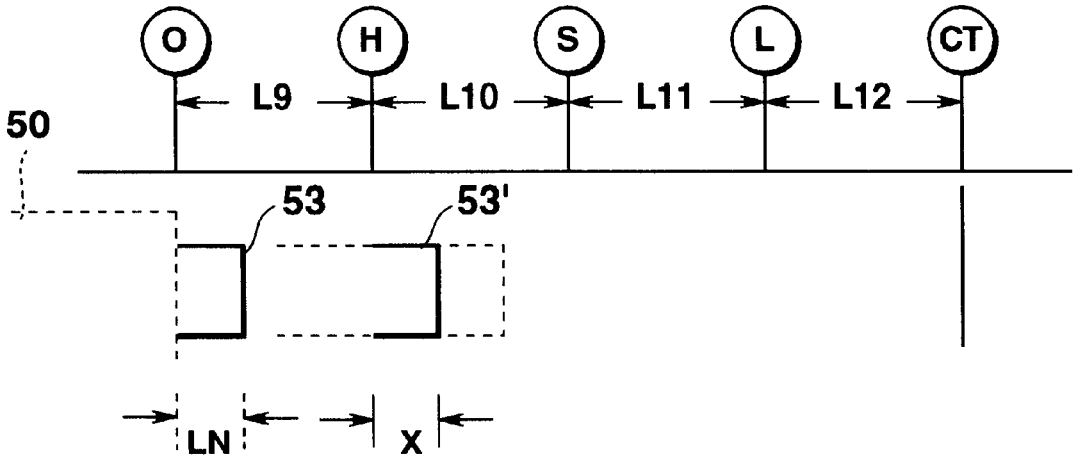
FIG. 19 diagrammatically shows the arrangement of the respective printer elements involved in the printing process performed by the printer of FIG. 18A.

FIG. 19 diagrammatically shows the arrangement of the respective elements of the printer involved in the printing process. Reference character "0" shown in a small circle denotes the position of a tape feeding port 56 in the cassette 50. Reference character "H" shown in a small circle at a distance of L9 from the position "0" denotes the position of the thermal head 545, reference character "S" shown in a small circle at a distance of L10 from the position "H" denotes the position of a shutter 543, reference character "L" shown in a small circle at a distance of L11 from the position "S" denotes the position of a lamp 44, and reference characters "CT" shown in a small circle at a distance of L12 from the position "L" denotes the position of the cutter 41. The tape sensor 42 is not shown.

Also, in this case, the tape 53 is beforehand pulled out by a length of LN from the cassette 50. A printed portion of the tape to be cut by the cutter 41 is not shown, and has an overall length of P with a printing area Q and a leading and a trailing margin X1 and X2 (X1=X2=X).

Figure 20:
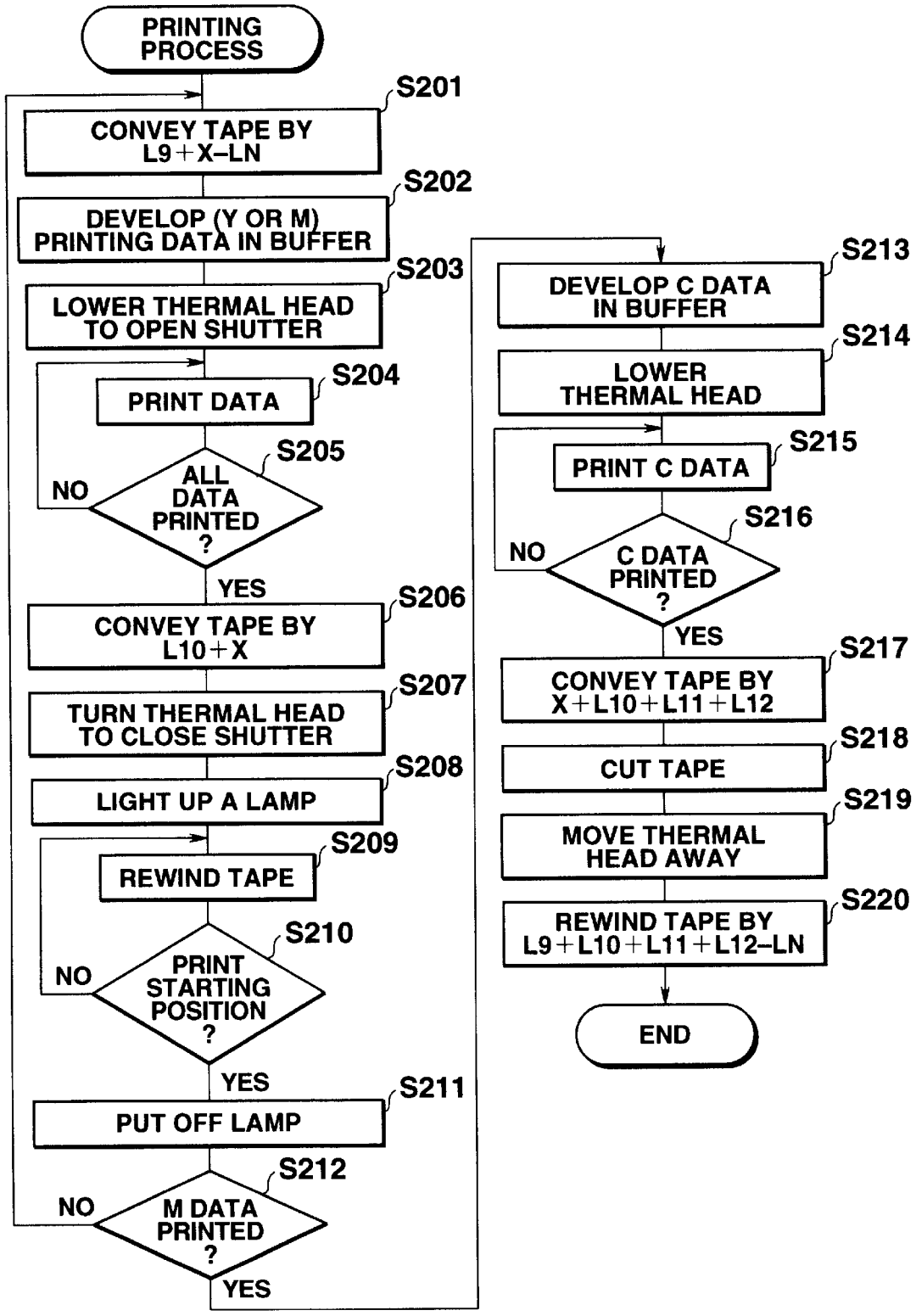
FIG. 20 is a flow chart of a printing operation performed by the printer of FIG. 18A.

FIG. 20 is a flow chart of a printing process performed by the CPU 90 of the controller. This printing process will be described next with reference to FIG. 20 and the arrangement of the respective elements concerned in FIG. 19.

First, the tape 53 is conveyed by a distance of L9+X−LN (step S201). Thus, the tape 53 which has been initially pulled out by the length of LN from the feeding port "0" is conveyed forwardly or downstream by a length of X (a leading margin portion) from the position "H" of the thermal head which is at the distance of L9 from the feeding port position "0", as shown by a tape 53' in FIG. 19 and stops, or the leading printing position of the printing area Q is set at the position "H" of the thermal head.

Subsequently, the CPU 90 develops printing data (first, yellow printing data) in a predetermined area of the RAM 92 (step S202), turns the turning arm 511 clockwise to lower the thermal head 545 from the guide plate 40 to open the ray cutting shutter 543 to set the thermal head 545 at its print starting position (step S203), rotates the platen roller 39 forwardly, and drives the thermal head 545 to produce heat with the developed printing data to thereby perform the printing (step S204).

When the CPU 90 monitors and confirms the termination of the printing (S205), it stops the heating operation of the thermal head 545, and continues to convey the tape 53 by a distance of L10+X (step S206). Thus, the tape is conveyed downstream of the conveyance path until an end of the printing area Q where the printing has ended comes to a point at a distance of X (a trailing margin) from the shutter position "S", which is at a distance of L10 from the position "H" of the thermal head, and then stops.

The CPU 90 then turns the turning arm 511 counterclockwise and hence the thermal head 545 to close the ray cutting shutter 543 (step S207). Thus, an unused portion of the tape 53 is shielded from the lamp position "L" with the printed tape portion of the overall length of P (including its leading and trailing margins) fed out from the shutter position S toward the lamp position L.

Subsequently, the CPU 90 lights up the lamp 44 (the yellow ray-fixing lamp 44*a* because the yellow printing is performed first) (step S208), rewinds the tape 53 (step S209), and monitors whether the tape 53 has been rewound until its leading end reaches its initial position (the position of the tape 53 shown leftward in FIG. 19) (step S210). If so, the CPU 90 stops the rewinding of the tape and puts off the lamp 44 (step S211). Thus, the printed portion of the overall length of P which contains the leading and trailing margins of the tape 53 is fixed in yellow. As described above, also in this embodiment, ray fixation is performed in the course where the tape 53 is conveyed back for rewinding purposes.

Subsequently, the CPU determines whether the just-terminated printing relates to magenta (step S212). If the printing relates to yellow, the CPU 90 returns its control to step S201, where it conveys the tape 53 of FIG. 19 to the position of the tape 53', develops the magenta printing data in the RAM 92 at step S202, and then repeats the processing at steps S203–S212. Thus, the CPU performs the magenta printing (coloring) and ray fixation, rewinds the tape 53 to its initial position, and again determines whether the just completed printing relates to magenta.

Now, the determination at step S212 is affirmative. Thus, the CPU 90 develops cyan data in the RAM 92 (step S213). The processing at subsequent steps S214–216 is identical to that at steps S203–205. When the CPU 90 confirms the completion of the cyan printing (S216), it conveys the tape 53 by a distance of X+L10+L11+L12 forwardly (step S217). Thus, the printed portion of the tape 53 stops with its trailing end at a distance of X (trailing margin) forward from the cutter position CT, which is at the distance of L10+L11+L12 from the thermal head position H. That is, the trailing end of the trailing margin of the printed tape portion stops at the cutter position CT.

Subsequently, the CPU 90 drives the movable blade 41*a* to cut away the printed tape portion 53 (step S218), turns the thermal head 545 clockwise (step S219), rewinds the tape 53 by a distance of L9+L10+L11+L12−LN (step S220), and then terminates this process. Also, in this case, by the above winding operation, an end of an unused portion of the tape 53 from which the printed portion is cut away stops at a position at a distance of LN downstream from the feeding port "0", which is at a distance of L9+L10+L11+L12 upstream from the cutter position CT for waiting for the next printing.

Rewinding the tape until the feeding port "0" may be performed immediately before the cassette 50 is removed away from the printer 500. In this case, when the determination at step S212 is negative in the process of FIG. 20, the CPU changes its process so that its control returns not to step S201 but to step S202.

Even when the shutter and lamp are disposed on a more downstream side of the conveyance path than the thermal head, as just described above, the shutter 543 may be replaced by the pair of auxiliary rolls 302 of FIGS. 15 and 16, which will be described next as an eighth embodiment.

Eight Embodiment

Figure 21A:
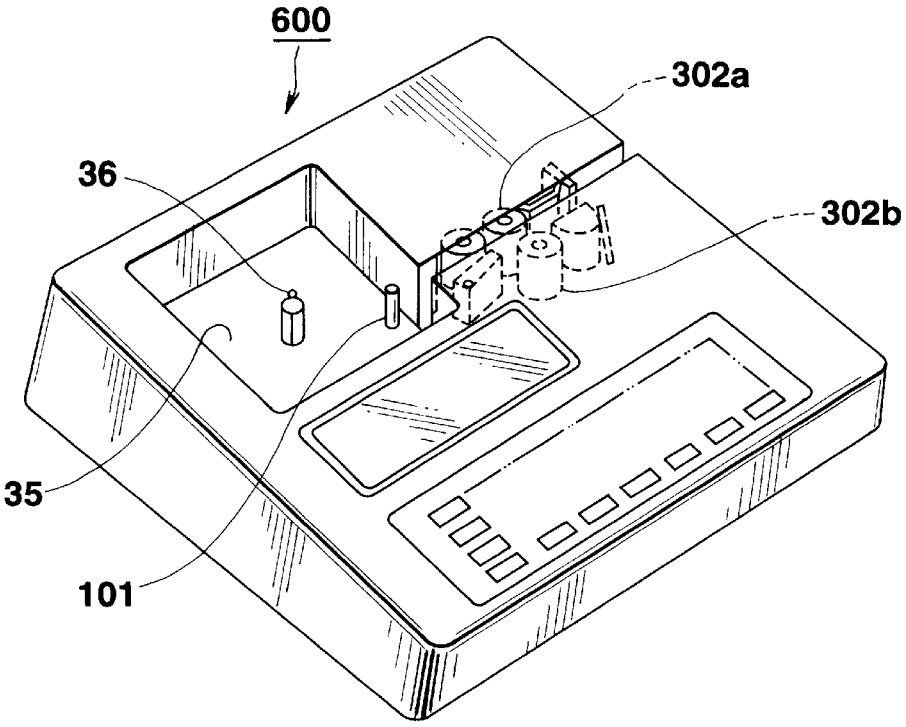
FIG. 21A is a simplified perspective view of a printer as an eighth embodiment of the present invention.
Figure 21B:
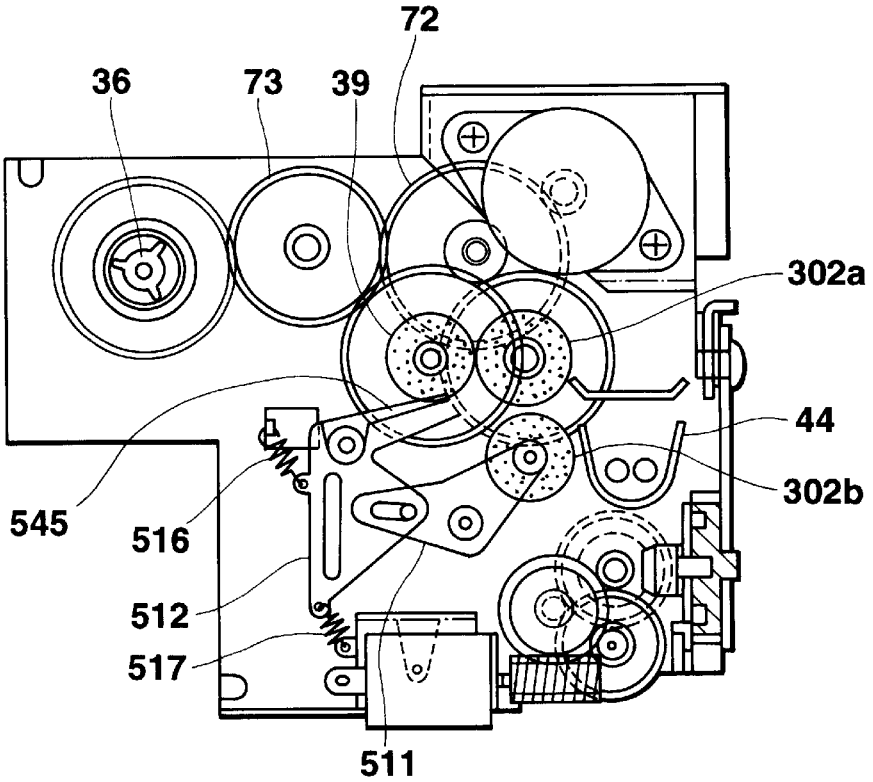
FIG. 21B shows a drive mechanism for the respective elements of the printer of FIG. 21A.

FIG. 21A is a simplified perspective view of a printer as an eighth embodiment. FIG. 21B shows the composition of its internal drive system. The printer 600 of FIGS. 21A and 21B is different from the printer 500 of FIGS. 18A and 18B in that in FIGS. 21A and 21B a pair of auxiliary rolls 302*a* and 302*b* each provided on a respective one of the sides of the conveyance path has replaced the ray cutting shutter 543 of the printer 500 of FIGS. 18A and 18B, and that compared to the guide plate 40 of FIGS. 18A and 18B, the guide plate 40 of FIGS. 21A and 21B is reduced in length by a quantity corresponding to a space which the roll 302*a* occupies. The other remaining structural portions of FIGS. 21A and 21B are identical to the corresponding ones of FIGS. 18A and 18B.

Figure 22B:
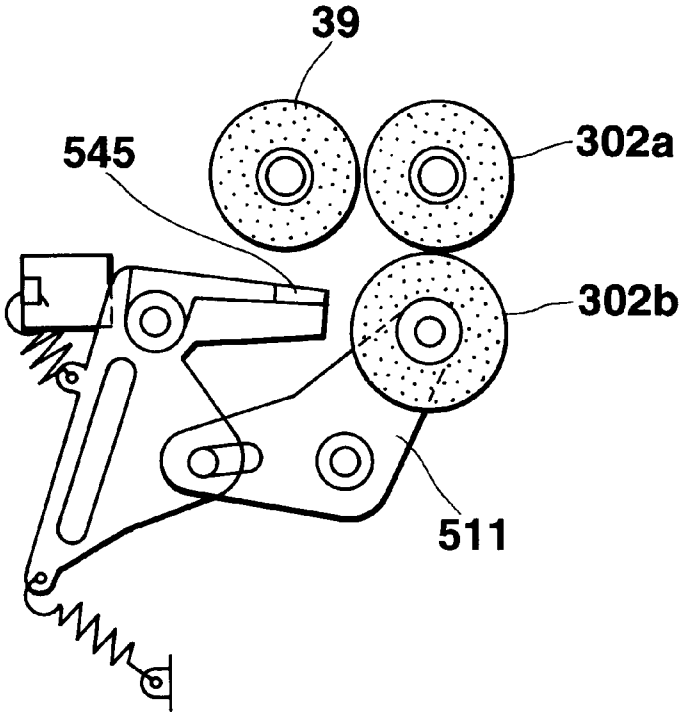
FIGS. 22A and 22B illustrate operation of a thermal head and a ray cutting shutter driven in interlocking relationship by the drive mechanism of FIG. 21B.
Figure 22A:
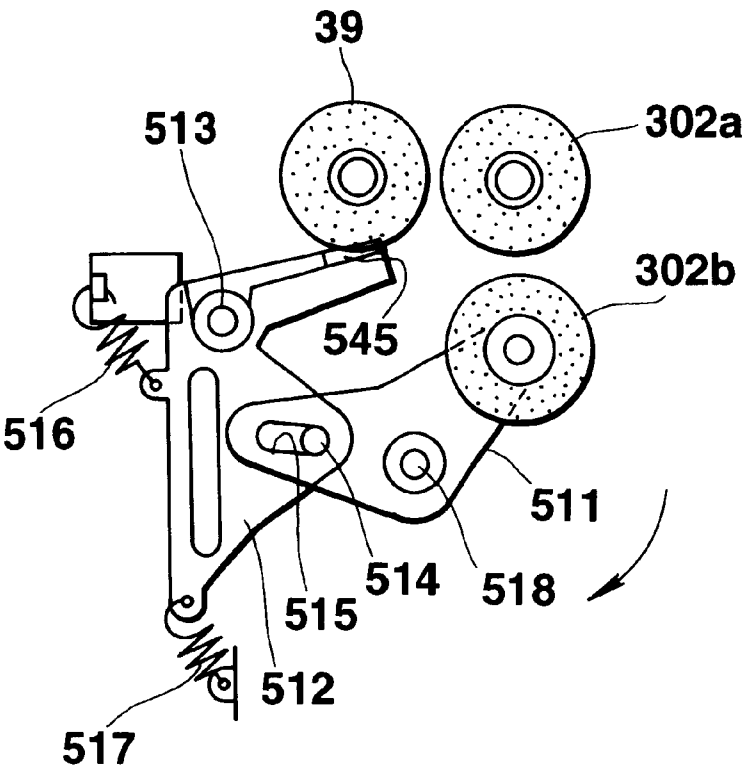
Figure 23:
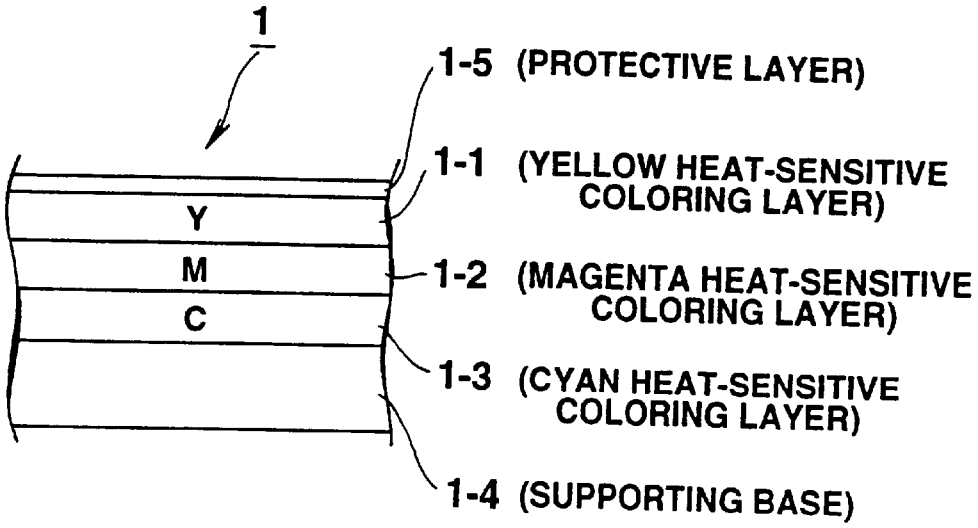
FIG. 23 is a cross-sectional view of heat-sensitive ray-responsive recording paper.
Figure 24:
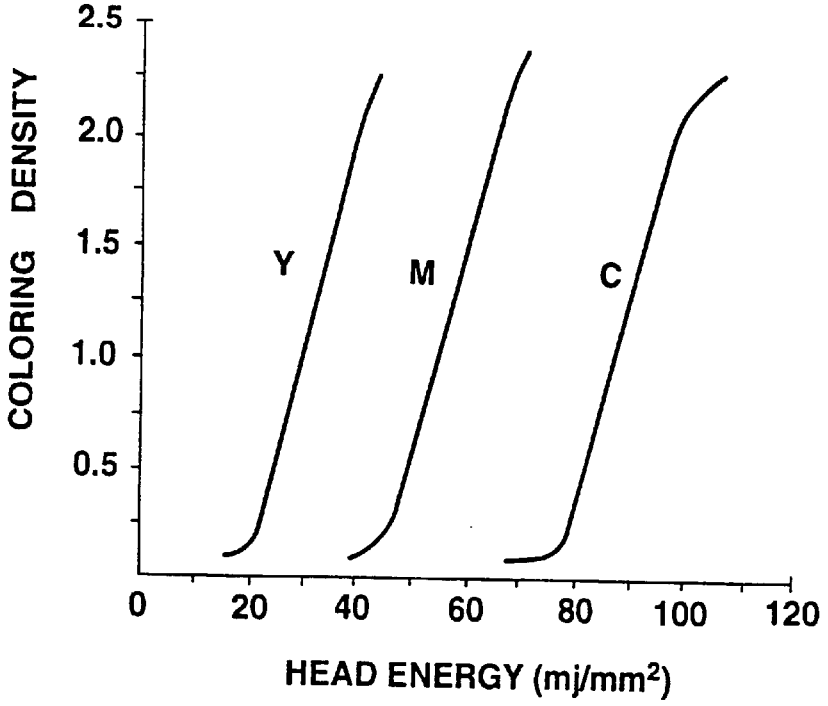
FIG. 24 illustrates the relationship between coloring density of each of coloring layers of the recording paper of FIG. 23 and heat energy applied to that coloring layer.
Figure 25:
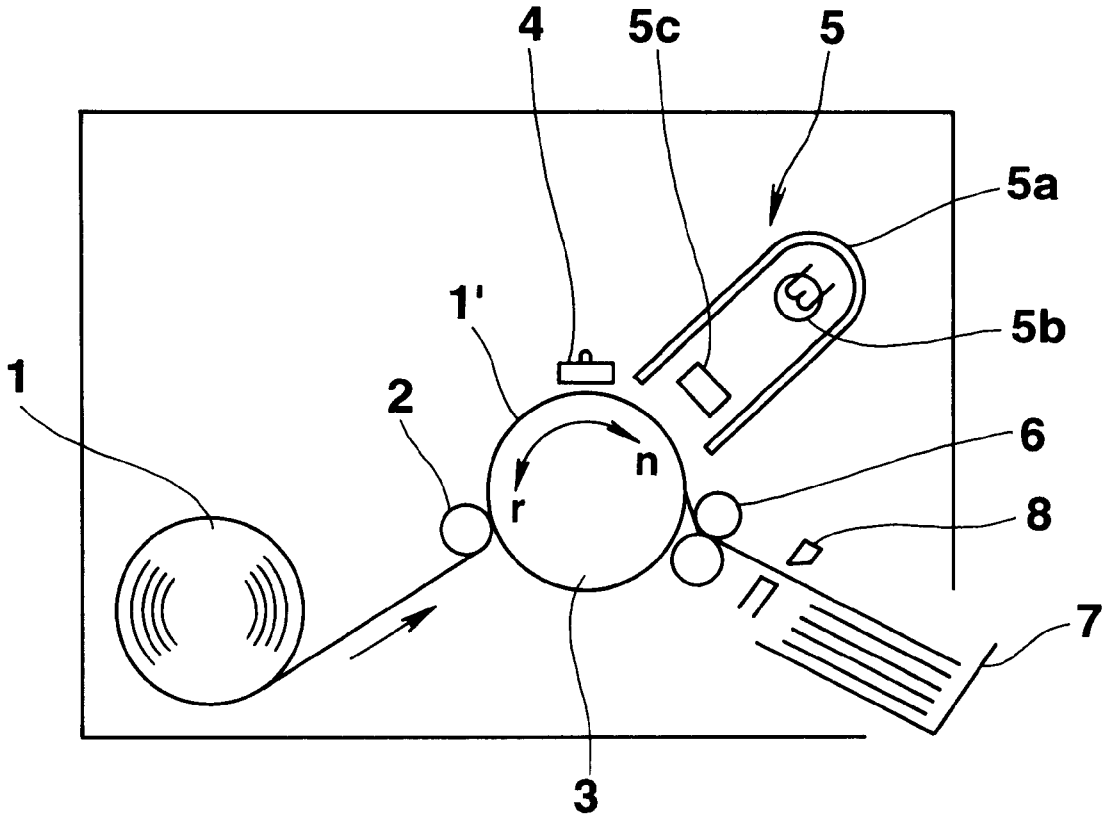
FIG.25 (PRIOR ART)
FIG. 25 illustrates a conventional printer which forms an image on heat-sensitive ray-responsive recording paper.
Figures 26, 26A:
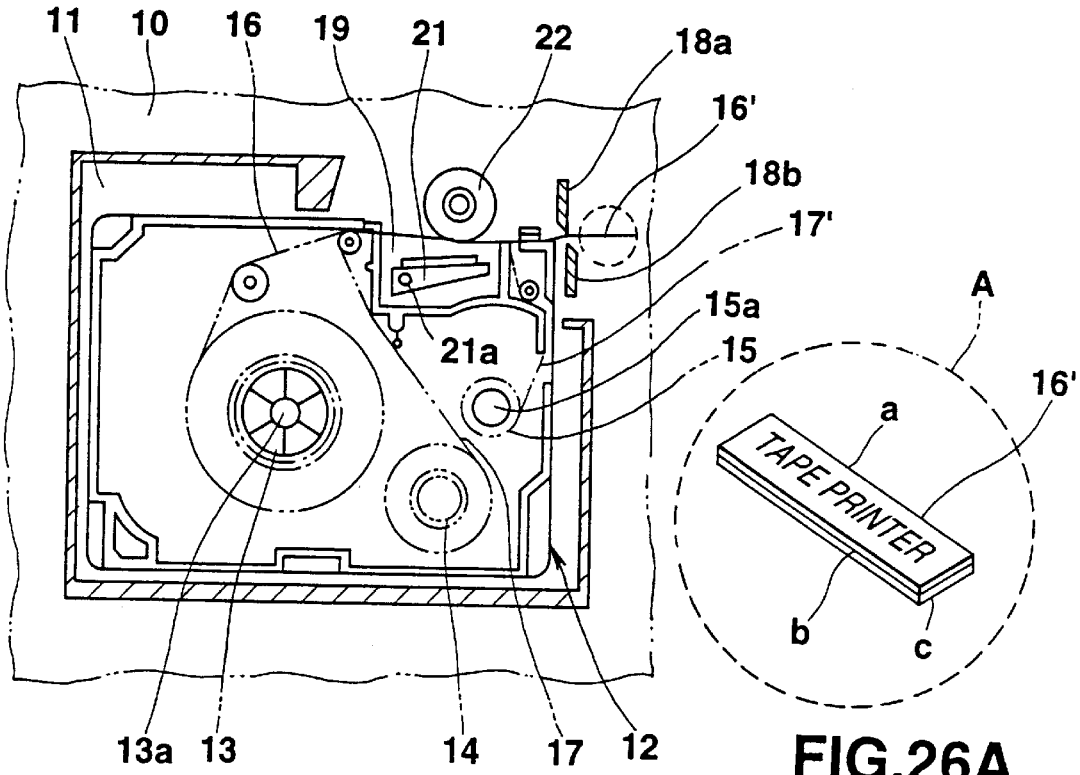
FIG.26A (PRIOR ART)
FIG.26 (PRIOR ART)
FIG. 26 is a cross-sectional view of a main portion of the conventional tape printer.
FIG. 26A is an enlarged view of a prior art printed paper tape.

FIGS. 22A and 22B each show the operation of the pair of rolls 302*a* and 302*b* and the thermal head 545 performed in an interlocking relationship. As shown in FIG. 22A, the roll 302*a* of the pair is positioned over the printer body downstream of the platen roller 39 side by side with the same. The turning arm 511 is supported rotatably at a pivot 518 with its right-hand portion supporting the other roll 302*b* rotatably at its end. FIG. 22A shows the turning arm 511 driven clockwise around the pivot 518, so that its right-hand arm portion is turned clockwise around the pivot 518 to move the roll 302*b* away from the roll 302*a*. The left-hand arm portion and hence its slot 515 are turned clockwise, so that a pin 514 of the turning member 512 is raised. Thus, the turning member 512 is turned counterclockwise around the pivot 513 to press the thermal head 545 against the platen roller 39.

FIG. 22B shows the turning arm 511 driven counterclockwise around the pivot 518. In this case, the right-hand portion of the turning arm 511 is also turned counterclockwise around the pivot 518 to press the rolls 302*b* against 302*a* to cut possible irradiation rays from the adjacent right-hand lamp 44 to protect the upstream tape portion from the fixing. In this case, the left-hand arm portion of the turning arm 511 and hence its slot 515 are also turned counterclockwise around the pivot 518, so that the second turning member 512 is pulled down through the pin 514. Thus, the turning member 512 turns clockwise around the pivot 513 to move the thermal head 545 away from the platen roller 39. Also, in this case, the printing process is performed as described in FIGS. 19 and 20.

As described above, according to the present invention, the ray cutting shutter is arranged so as to act in conjunction or interlock with the movement of the thermal head to its non-printing position after the thermal head has performed its printing operation with its produced heat. Thus, the timings of ray cutting by the ray cutting shutter and start of the ray fixation and the range of irradiation of the fixing rays onto the printing tape are set accurately. Thus, a range of ray fixation of the printed tape portion is set accurately to obtain an excellent color image produced by accurate superposition of three colored primary colors. Thus, a printer of a special type including a tape printer using a heat-sensitive ray-responsive printing medium is actually provided.

Since a cassette case which accommodates a heat-sensitive ray-responsive printing medium is composed of a material which cuts at least ultraviolet rays of the same wavelength as the fixing rays, useless exposure of the printing medium before its use is avoided. Since the cassette case has a transparent window 54 of a UV cutting transparent resin through which the inside of the case is visible to the naked eye, the quantity of a roll of heat-sensitive ray-responsive printing medium in the form of a tape remaining within the case can be easily recognized through the window 54.

What is claimed is:

1. A tape printer comprising:

means for providing a cassette accommodating space which enables a printing tape cassette to be removably accommodated therein, the printing tape cassette including a heat-sensitive ray-responsive printing medium tape having a plurality of coloring layers formed on one surface of a support base, said printing medium tape being wound around a reel, the plurality of coloring layers being adapted to be colored as different colors at corresponding temperatures and fixed by fixing rays of different wavelengths, a peelable piece pasted on an other surface of said support base, and a case enclosing said printing medium tape, said case being made of a material which cuts the fixing rays, said case having on a side thereof a port through which the printing medium tape is passable into and out of the case, the port preventing the fixing rays from entering the case;

tape conveying means for performing forward conveyance of the printing medium tape from said case through said port and for performing backward conveyance of the printing medium tape into said case;

a thermal head for thermally printing an image on the printing medium tape conveyed by said tape conveying means, the image being printed through the width of the printing medium tape;

input means for inputting image information regarding an image to be formed on the printing medium tape;

thermal head drive controlling means for driving said thermal head at a plurality of different temperatures on the basis of the image information input by said input means when said tape conveying means performs the forward conveyance of the printing medium tape a corresponding plurality of times to sequentially color the plurality of coloring layers in a corresponding plurality of colors in the same area of the printing medium tape;

fixing ray irradiating means for sequentially irradiating the printing medium tape with a plurality of fixing rays of different wavelengths corresponding to the plurality of coloring layers of the printing medium tape after the respective corresponding driving operations of said thermal head to fix the respective produced colors of the coloring layers;

irradiation range limiting means for limiting a range of irradiation of the fixing rays of the different wavelengths by said fixing ray irradiating means to a predetermined range of the printing medium tape; and fixing range controlling means for controlling a quantity of conveyance of the printing medium tape by said tape conveying means and the operation of said fixing ray irradiation means so that an upstream side of the printing medium tape is not irradiated with the fixing rays of the different wavelengths beyond said same area, on which the plurality of coloring layers are colored, in the direction of forward conveyance of the printing medium tape.

2. The tape printer according to claim 1, wherein the operation of said fixing ray irradiating means is controlled in the course where the forward conveyance of the printing medium tape is performed.

3. The tape printer according to claim 1, wherein the operation of said fixing ray irradiating means is controlled in the course where the backward conveyance of the printing medium tape is performed.

4. The tape printer according to claim 1, wherein said irradiation range limiting means comprises a movable shutter means.

5. The tape printer according to claim 4, further comprising means for moving said thermal head into contact with and away from the printing medium tape, and an interlocking mechanism for interlocking operation of said movable shutter means with the movement of said thermal head into contact with and away from said printing medium tape.

6. The tape printer according to claim 1, wherein said irradiation range limiting means comprises a cover with a slit therein through which the fixing rays are allowed to pass only in a predetermined direction.

7. The tape printer according to claim 1, wherein said tape conveying means conveys the printing medium tape until its leading end fed out from said case when the printing starts reaches a position beyond said thermal head in the direction in which the forward conveyance of the printing medium tape is performed; and said thermal head drive control means drives said thermal head after said printing medium tape is conveyed by said tape conveying means to color the image for the image information input by said input means in an area of the printing medium tape subsequent to its leading end portion.

8. The tape printer according to claim 7, further comprising cutter means for cutting away the leading end portion of the printing medium tape conveyed by said tape conveying means.

9. The tape printer according to claim 1, further comprising tape sensing means for sensing a portion of the printing medium tape fed out from said case, and wherein:

said conveying tape is responsive to the sensing of the portion of the printing medium tape by said tape sensing means to automatically return into said case the portion of the printing medium tape fed out from said case when said printing tape cassette is removed from said cassette accommodating space or when a series of printing operations concerned has been completed.

10. The tape printer according to claim 1, wherein said case has a window for cutting the fixing rays and for visually confirming therethrough a possible printing medium tape present within said case.

11. The tape printer according to claim 10, wherein said printing medium tape is wound so that its printing surface appears outside.

12. The tape printer according to claim 10, wherein said case takes the form of a substantially square box with the port provided on a corner of a side thereof.

13. A printing medium accommodating cassette comprising:

a heat-sensitive ray responsive printing medium tape which includes a plurality of coloring layers formed on one surface of a support base and wound around a reel, the plurality of coloring layers being adapted to be different colors at corresponding temperatures and fixed by fixing rays of different wavelengths, and a removable piece affixed on an other surface of said support base; and a case enclosing said printing medium tape, said case being made of a material which cuts the fixing rays, said case having on a side thereof a port through which the printing medium is conveyed into and out of the case, the port preventing the fixing rays from entering the case;

wherein the cassette is settable on a printer which includes a thermal head for applying heat energy based on image information to a portion of the printing medium fed out from said case to color the printing medium portion and fixing ray irradiation means for irradiating the colored printing medium portion with fixing rays to fix the colors produced on the printing medium portion.

14. The tape cassette according to claim 13, wherein said case has a window for cutting the fixing rays and for visually confirming therethrough the presence of a possible printing medium tape within said case.

15. The tape cassette according to claim 13, wherein said printing tape is wound around the reel so that its printing surface appears outside.

16. The tape cassette according to claim 15, wherein said case takes the form of a substantially square box with the port provided on a side thereof.

* * * * *